US010898004B2

(12) United States Patent
Nitori et al.

(10) Patent No.: US 10,898,004 B2
(45) Date of Patent: Jan. 26, 2021

(54) FURNITURE AND BED-SOFA BODY

(71) Applicant: Nitori Holdings Co., Ltd., Hokkaido (JP)

(72) Inventors: Akio Nitori, Tokyo (JP); Kouichi Imai, Tokyo (JP)

(73) Assignee: Nitori Holdings Co., Ltd., Hokkaido (JP)

( * ) Notice: Subject to any disclaimer, the term of this patent is extended or adjusted under 35 U.S.C. 154(b) by 284 days.

(21) Appl. No.: 15/943,846

(22) Filed: Apr. 3, 2018

(65) Prior Publication Data

US 2018/0303242 A1 Oct. 25, 2018

(30) Foreign Application Priority Data

Apr. 20, 2017 (JP) ..... 2017-084054

(51) Int. Cl.
*A47C 17/13* (2006.01)
*A47C 19/22* (2006.01)
(Continued)

(52) U.S. Cl.
CPC ..... *A47C 17/136* (2013.01); *A47C 17/04* (2013.01); *A47C 17/86* (2013.01); *A47C 19/22* (2013.01)

(58) Field of Classification Search
CPC ..... A47C 17/136; A47C 17/04; A47C 17/86; A47C 19/22; A47C 27/05; A47C 27/15;
(Continued)

(56) References Cited

U.S. PATENT DOCUMENTS 2,907,053 A * 10/1959 Fox ..... A47C 17/138 5/12.1
3,028,607 A * 4/1962 Anderson ..... A47C 17/136 5/17

(Continued)

FOREIGN PATENT DOCUMENTS

JP S41-022455 U 11/1966
JP S64-004232 U 1/1989

(Continued)

OTHER PUBLICATIONS

Japanese Office Action for Japanese Pat. Appln. No. 2017-084054 dated Aug. 29, 2017.

*Primary Examiner* — Eric J Kurilla
*Assistant Examiner* — James T Coble
(74) *Attorney, Agent, or Firm* — IPUSA, PLLC

(57) ABSTRACT

A furniture item includes a body including first side plates in a first direction, a second side plate on a first side in a second direction, and a horizontal stand that forms a horizontal surface extending from the second side plate; a floor plate part that is enabled to slide between a first position and a second position that is on the second side relative to the first position; a mattress part that is enabled to be placed on the floor plate part; and a cushion element that is enabled to be placed on the mattress part. An upper side surface of the mattress part extends at a height lower than a lower end of the horizontal stand, and a space is formed under a horizontal surface of the horizontal stand in a state in which the floor plate part is at the second position.

13 Claims, 20 Drawing Sheets

(51) Int. Cl.
*A47C 17/86* (2006.01)
*A47C 17/04* (2006.01)

(58) Field of Classification Search
CPC . A47C 17/22; A47C 17/1753; A47C 17/2073; A47C 19/205
See application file for complete search history.

(56) References Cited

U.S. PATENT DOCUMENTS 3,047,885 A * 8/1962 Bolinger ..... A47C 17/132 5/9.1
7,386,903 B2 * 6/2008 Hochschild ..... A47C 27/001 5/691

FOREIGN PATENT DOCUMENTS

JP H01-108148 U 7/1989
JP 2007-068833 3/2007
JP 2015-533587 11/2015

* cited by examiner

FURNITURE AND BED-SOFA BODY

BACKGROUND OF THE INVENTION

1. Field of the Invention

The present invention relates to furniture and a bed-sofa body.

2. Description of the Related Art

Regarding a housing structure of a bed that is switchable to a sofa, a technique in which side plates of a cabinet are enabled to slide and rotate is known. According to the above-described housing structure, it is possible for a user to take out a backrest from within the cabinet and to push a portion of a bed body into the cabinet when switching the bed to the sofa, and to pull the bed body out of the cabinet and to store the backrest within the cabinet when switching the sofa to the bed.

CITATION LIST

Patent Document

[Patent Document 1] Japanese Unexamined Patent Application Publication No. 2007-068833

SUMMARY OF THE INVENTION

However, in the above-described conventional technique, the structure is relatively complicated because the side plates of the cabinet are movable parts. In other words, the structure is relatively complicated due to a mechanism (pinion gear, rack gear, rotation shaft, etc.) that enables the side plates of the cabinet to slide and rotate. When the structure of the cabinet is relatively complicated, not only the number of parts and costs will be increased, but also it becomes difficult to secure a space within the cabinet (e.g., a space for storing the backrest) and there is a risk of the increased size of the cabinet, etc.

Therefore, an object of an aspect of the present invention is to provide a furniture and a bed-sofa body that are enabled to switch between a form of a bed and a form of a sofa with relatively a simple structure.

An aspect of the present invention provides a furniture that includes: a body that includes first side plates on two sides in a first direction, a second side plate on a first side in a second direction that is perpendicular to the first direction and to an up-and-down direction, and a horizontal stand that forms a horizontal surface extending from the second side plate towards a second side that is opposite to the first side in the second direction; a floor plate part that is enabled to slide in the second direction between a first position at which the floor plate part overlaps the horizontal stand in a top view and a second position that is on the second side relative to the first position; a mattress part that is enabled to be placed on the floor plate part; and a cushion element that is enabled to be placed on the mattress part in a state in which the floor plate part is at the first position and the cushion element abuts onto the horizontal stand in the second direction, wherein an upper side surface of the mattress part extends at a height lower than a lower end of a side surface of the horizontal stand on the second side in the second direction in a placed state in which the mattress part is placed on the floor plate part, a space is formed under a horizontal surface of the horizontal stand in a state in which the floor plate part is at the second position, the space being capable of storing the cushion element, and the space being next to the mattress part in the placed state, and a part of the second side of the mattress part in the second direction in the placed state is in the space in a state where the floor plate part is at the first position.

According to an aspect of the present invention, a furniture and a bed-sofa body that are enabled to switch between a form of a bed and a form of a sofa with relatively a simple structure are obtained.

DETAILED DESCRIPTION OF THE PREFERRED EMBODIMENTS

In the following, referring to the accompanying drawings, embodiments of the present invention will be described in detail.

Figure 1:
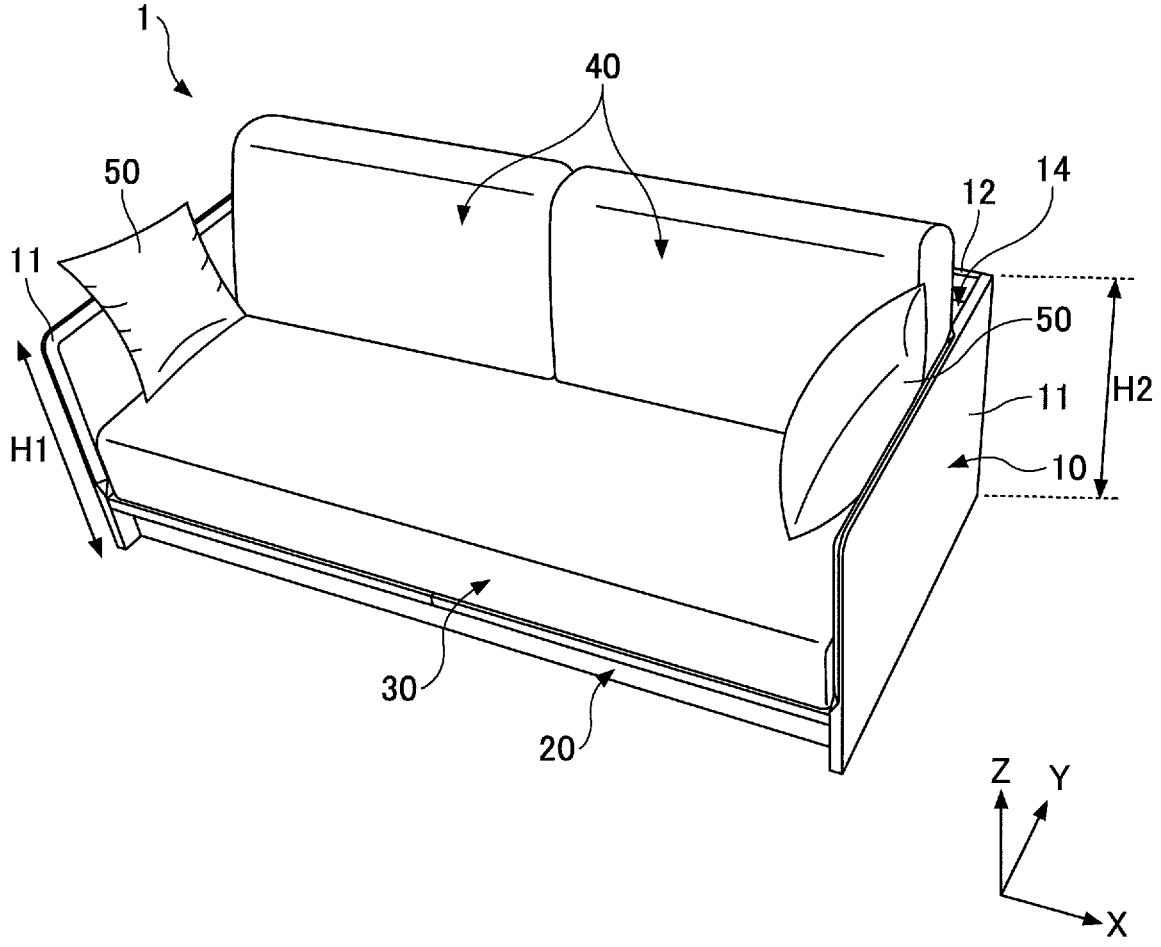
FIG. 1 is a perspective view illustrating furniture according to an embodiment of the present invention in a form of a sofa.
Figure 2:
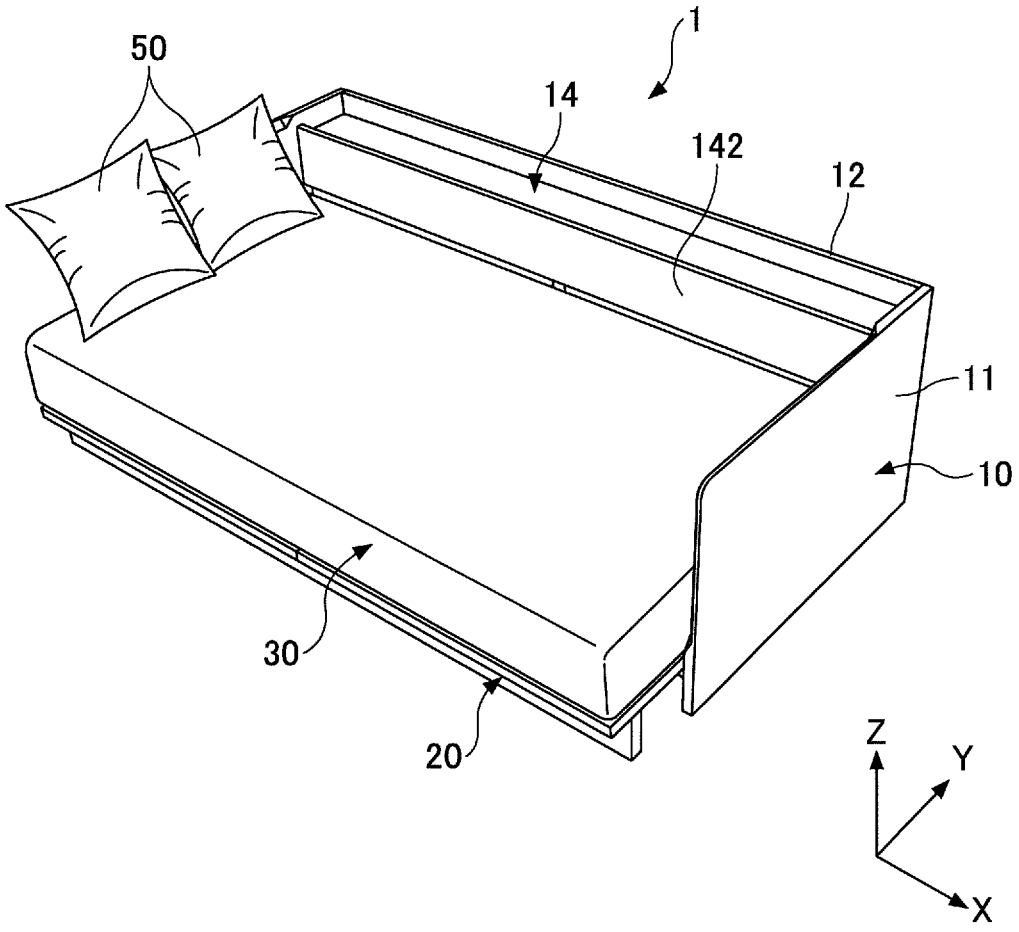
FIG. 2 is a perspective view illustrating the furniture in a form of a bed.
Figure 3:
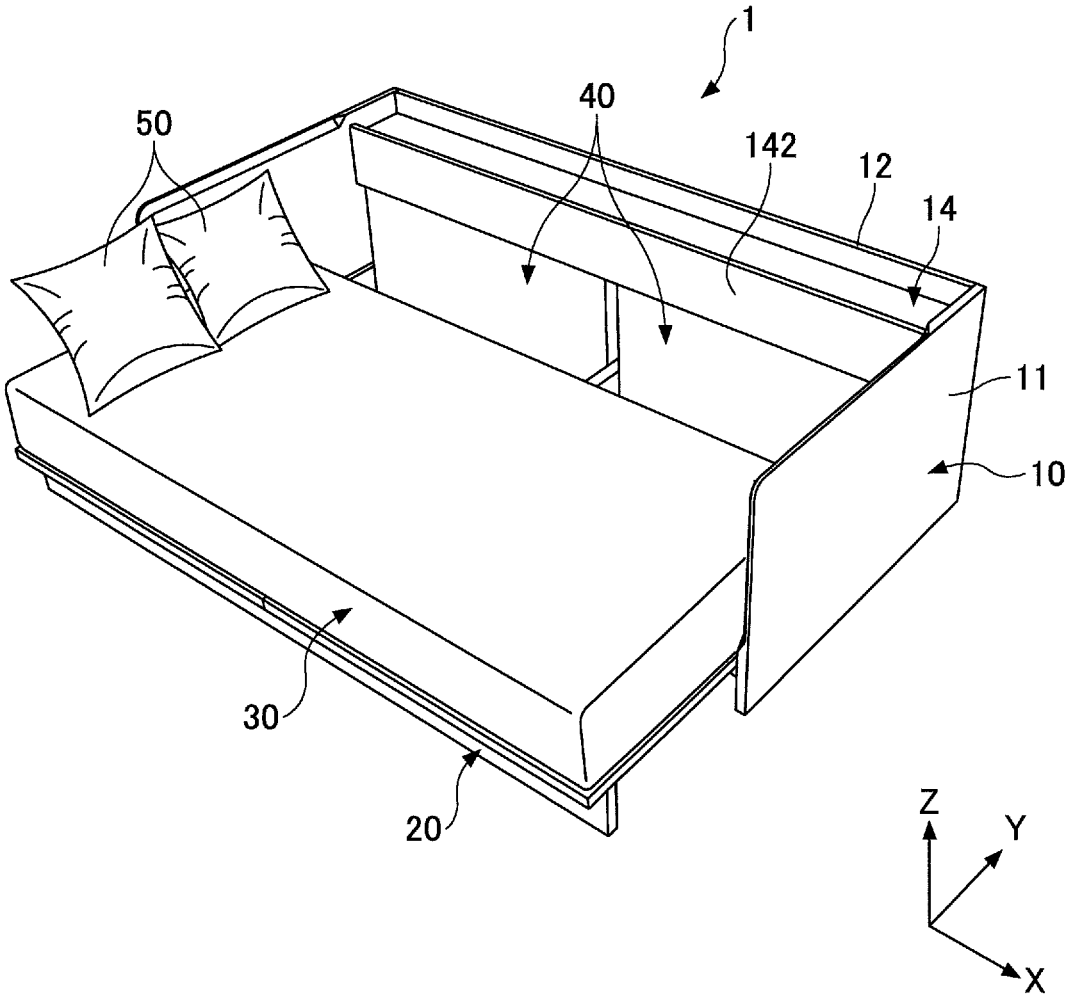
FIG. 3 is a perspective view illustrating the furniture in an intermediate state.

FIG. 1 through FIG. 3 are perspective views that schematically illustrate furniture 1 according to an embodiment of the present invention. FIG. 1 illustrates the furniture 1 in a form of a sofa, and FIG. 2 illustrates the furniture 1 in a form of a bed. FIG. 3 illustrates the furniture 1 in an intermediate state, which is a transition state between the form of a sofa and the form of a bed. FIG. 3 illustrates a state in which a slide floor plate 20 is pulled out further towards the near side. It should be noted that FIG. 2 and FIG. 3 illustrate a state in which main cushions 40 are stored in a storage space 70.

X axis, Y axis, and Z axis, which are perpendicular to each other, are shown in FIG. 1 and FIG. 2. X direction (an example of a first direction) and Y direction (an example of a second direction) are in a horizontal plane, and Z direction corresponds to an up-and-down direction. The Y direction corresponds to a slide direction of the slide floor plate 20 which will be described below. In the following, for the sake of description convenience, it is assumed that the positive side of the Y direction is a "far side (back side)" (an example of a first side), and the negative side of the Y direction is a "near side (front side)" (an example of a second side).

As illustrated in FIG. 1 and FIG. 2, the furniture 1 is functional furniture that is enabled to switch between the form of the bed and the form of the sofa. Therefore, it is possible for a user to use the furniture 1 as a bed and to use the furniture 1 as a sofa.

The furniture 1 is installed in a house of the user. The user can freely select how to use the furniture 1. For example, it is preferable that the furniture 1 be installed in a living room of the house because the furniture 1 can take the form of the sofa. In this case, it is possible to use the furniture 1 as a bed in the living room by switching the furniture 1 to the form of the bed. On the other hand, it is also preferable that the furniture 1 be installed in a bed room of the house. In this case, it is possible to use the furniture 1 as a sofa in the bed room by switching the furniture 1 to the form of the sofa.

The furniture 1 includes a body 10, a slide floor plate 20 (an example of a floor plate part), a mattress 30 (an example of a mattress part), main cushions 40 used for a backrest (an example of a cushion element), and sub-cushions 50.

Figure 4:
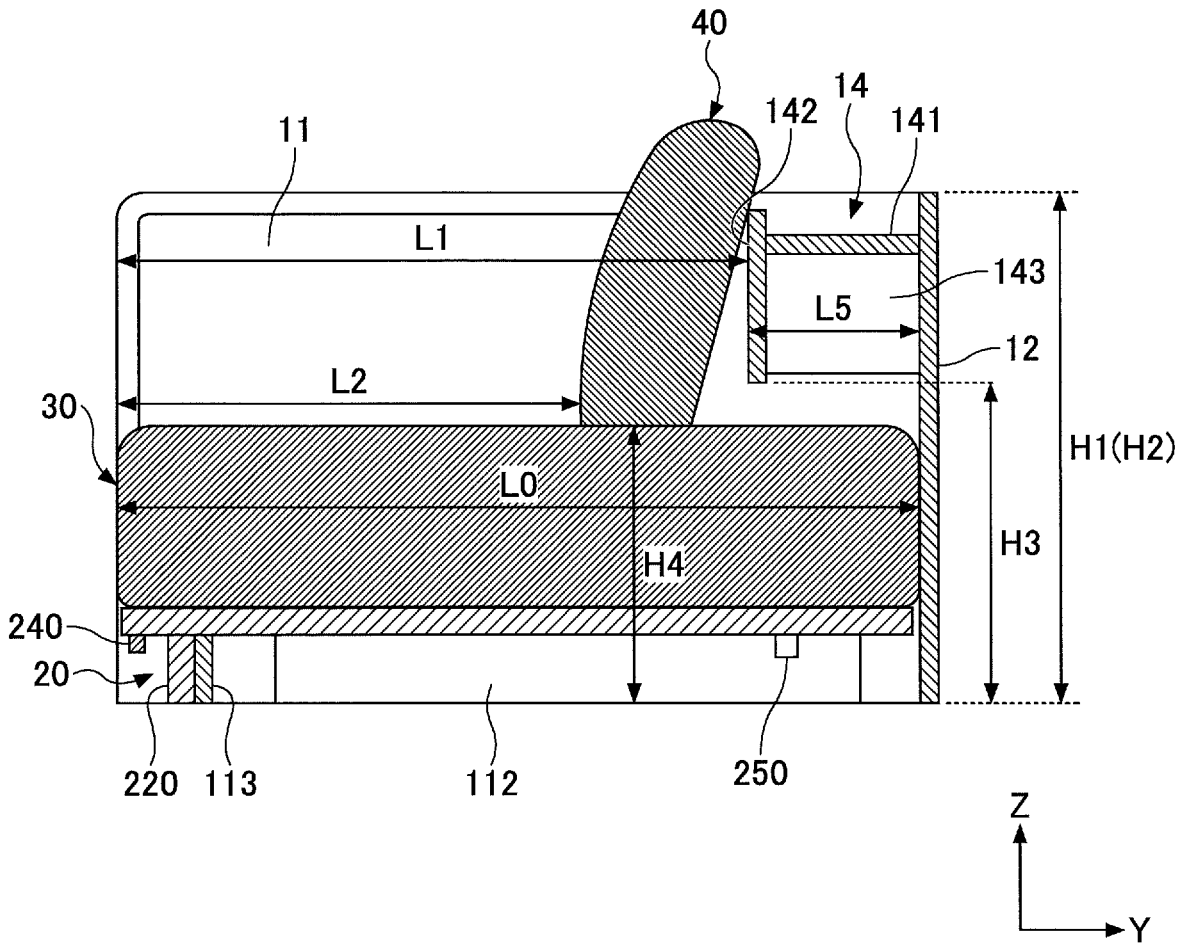
FIG. 4 is a schematic sectional view of the furniture in a form of a sofa illustrated in FIG. 1.
Figure 5A:
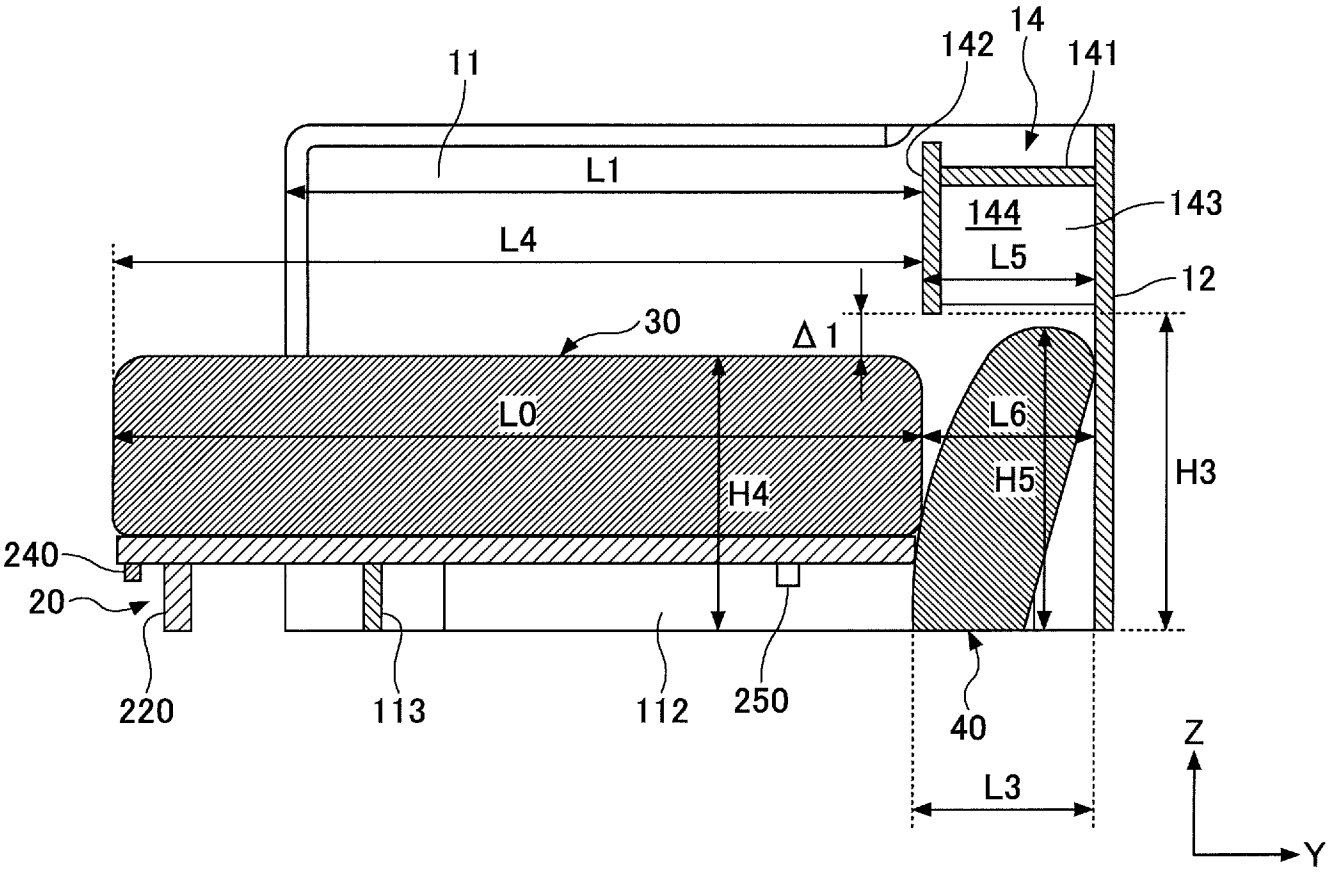
FIG. 5A is a schematic sectional view of the furniture in a form of a bed illustrated in FIG. 2.
Figure 5B:
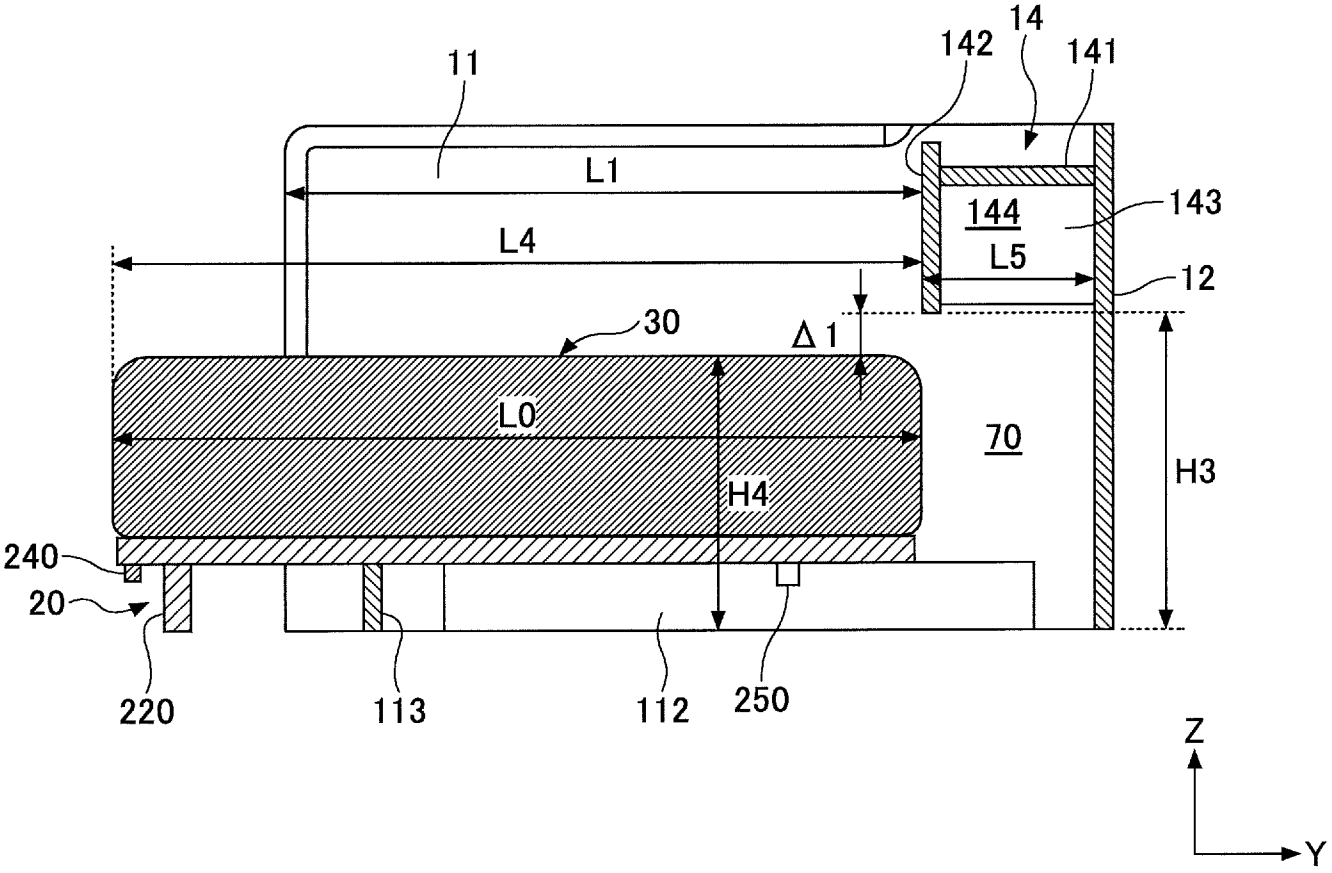
FIG. 5B is a drawing illustrating a state in which there is no main cushion in a storage space in FIG. 5A.
Figure 6:
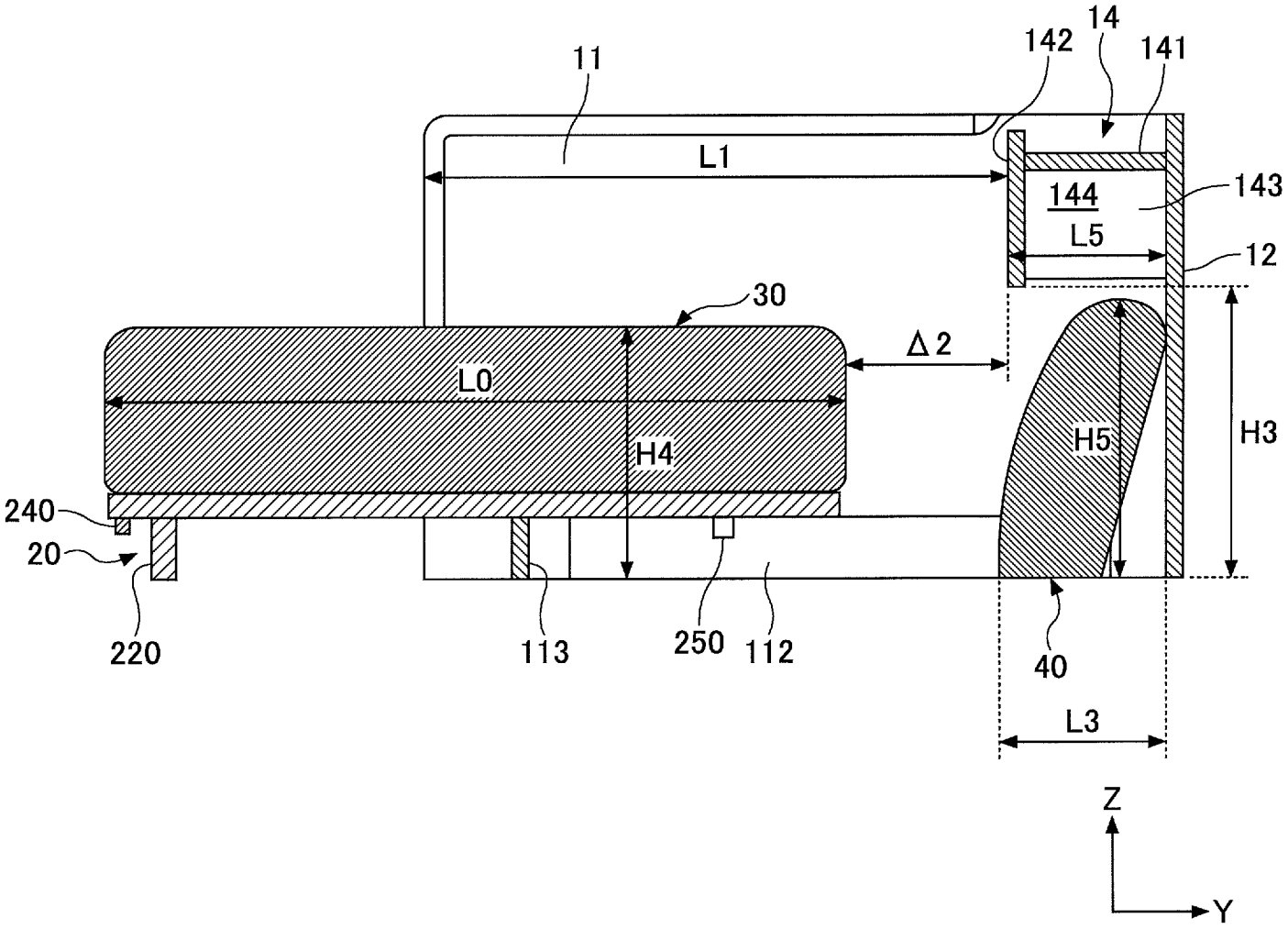
FIG. 6 is a schematic sectional view of the furniture in the intermediate state illustrated in FIG. 3.
Figure 7A:
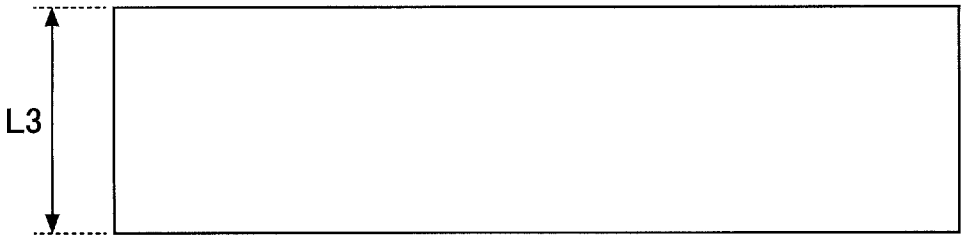
FIGS. 7A-7C are three-sided views of the main cushion.
Figure 7B:
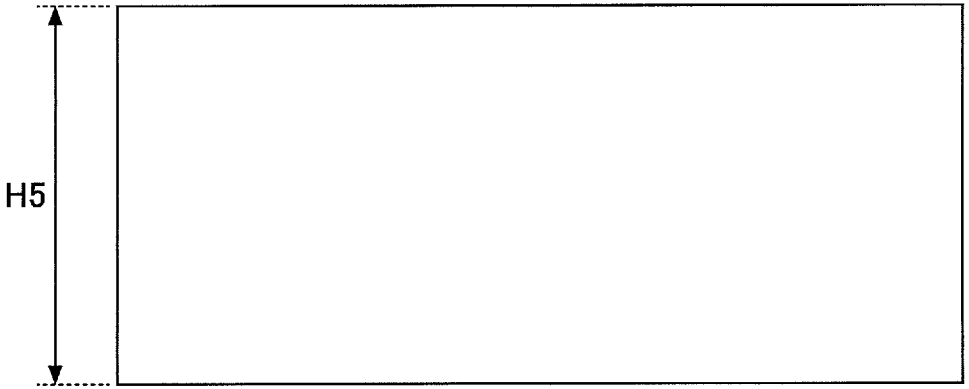
Figure 7C:
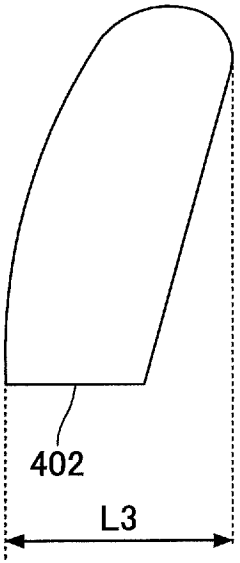

Next, further referring to FIG. 4 through FIGS. 7A-7C, the furniture 1 will be described in detail. FIG. 4 is a schematic section view of the furniture 1 in the form of the sofa illustrated in FIG. 1. FIG. 4 is a section view in case of cutting the furniture 1 at a position (a position at which a convex part 240, which will be described later, is included) with a YZ plane. FIG. 5A is a schematic section view of the furniture 1 in the form of the bed illustrated in FIG. 2. FIG. 5A is a section view in case of cutting the furniture 1 at the same position as in FIG. 4 with the YZ plane. FIG. 5B is a drawing illustrating a state in which there is no main cushion 40 in the storage space 70 in FIG. 5A. FIG. 6 is a schematic section view of the furniture 1 in the intermediate state illustrated in FIG. 3. FIG. 6 is a section view in case of cutting the furniture 1 at the same position as in FIG. 4 with the YZ plane. FIGS. 7A-7C are three-sided views of one of the main cushions 40.

The body 10 is made of, for example, wood. The body 10 is supported, at an installation place of the furniture 1, by a floor surface of the installation place (e.g., a floor surface made of a wooden floor or a carpet). The body 10 is an element that is not movable with respect to the floor surface. In other words, different from the slide floor plate 20 that will be described later, the body 10 itself is incapable of functional movement, and is substantially a fixed element with respect to the floor surface. For example, the furniture 1 may be installed in a form in which the far side of the body 10 abuts onto a wall of the installation place in the Y direction.

The body 10 includes first side plates 11 on two sides in the X direction, and a second side plate 12 and a horizontal stand 14 on the far side.

As illustrated in FIG. 1, etc., the first side plates 11 extend from the floor surface to a predetermined height H1. When the furniture 1 is in the form of the sofa, the first side plates 11 are positioned on the right and left sides for a user who sits on the sofa. At this time, the first side plates 11 may function as armrests. For example, in an example illustrated in FIG. 1, the sub-cushions 50 are placed against the first side plates 11 on two sides. When the furniture 1 is in the form of the bed, the first side plates 11 are positioned on the head side and the leg side for the user who lies on the bed. At this time, the first side plate 11 on the head side may function as a part that supports pillows in a slanted state. For example, in an example illustrated in FIG. 2, against the first side plate 11 on one side, two sub-cushions 50 capable of functioning as pillows are placed side by side in the Y direction.

The second side plate 12 extends between the first side plates 11 on two sides in the X direction. When the furniture 1 is in the form of the sofa, the second side plate 12 is positioned on the back side for the user who sits on the sofa. Further, when the furniture 1 is in the form of the bed, the second side plate 12 is positioned on one of the left side and the right side for the user who lies on the bed.

Because the second side plate 12 may be visible depending on how the furniture 1 is installed, it is preferable that the second side plate 12 extend entirely between the first side plates 11 on two sides in the X direction, and extend entirely from the floor surface to a predetermined height H2 (refer to FIG. 1 and FIG. 4). The predetermined height H2 may be the same as the predetermined height H1 of the first side plates 11 as illustrated in FIG. 1 and FIG. 4. It should be noted, however, that a hole or a notch may be formed in the second side plate 12 in a modified example. For example, the second side plate 12 may extend only within a height range of the horizontal stand 14 that will be described later. In other words, the second side plate 12 may be formed as a plate on the far side of the horizontal stand 14 that will be described later.

The horizontal stand 14 extends from the second side plate 12 toward the near side. The far side of the horizontal stand 14 is attached to the second side plate 12. The horizontal stand 14 may be formed integrally with the second side plate 12. Further, the horizontal stand 14 extends between the first side plates 11 on two sides in the X direction, and the two sides of the horizontal stand 14 in the X direction are attached to the first side plates 11. It should be noted, however, that the horizontal stand 14 may be provided partially between the first side plates 11 on two sides in the X direction.

The horizontal stand 14 functions as a shelf or a table (hereinafter, referred to as "shelf"). In other words, the horizontal stand 14 functions as a shelf on which an object can be placed. For example, a lighting equipment, a cup of water, a clock, a remote controller, a mobile terminal, a book, etc., may be placed on the horizontal stand 14. When the furniture 1 is in the form of the sofa, the horizontal stand 14 is positioned on the back side for the user who sits on the sofa. Therefore, it is possible for the user to place an object, if any, on the shelf behind, which improves the convenience. Further, when the furniture 1 is in the form of the bed, the second side plate 12 is positioned on one of the left side and the right side for the user who lies on the bed. Therefore, it is possible for the user to place an object, if any, on the shelf beside, which improves the convenience.

The horizontal stand 14 includes a first plate-shaped part 141, a second plate-shaped part 142, and a third plate-shaped part 143 as illustrated in FIG. 4 through FIG. 6. The first plate-shaped part 141 forms a horizontal surface of the horizontal stand 14. The horizontal surface functions as a placement surface on which an object is placed (placement surface of a shelf). The second plate-shaped part 142 forms a side surface of the horizontal stand 14 on the near side. The third plate-shaped part 143 is provided in the center portion of the horizontal stand 14, and extends within the YZ plane. The third plate-shaped part 143 has a function of securing the strength and the rigidity of the horizontal stand 14 by being connected to surfaces on back sides (storage space 70 sides that will be described later) of the first plate-shaped part 141 and the second plate-shaped part 142. It should be noted that a plurality of the third plate-shaped parts 143 may be provided at different positions in the X direction, or may be omitted, in a modified example.

As illustrated in FIG. 4 through FIG. 6, an upper end of the second plate-shaped part 142 of the horizontal stand 14 extends, together with an upper end of the second side plate 12, higher than the first plate-shaped part 141. With the above arrangement, it is possible to form walls on the far side and the near side of the horizontal surface (placement surface) of the horizontal stand 14 (viewed as a concave shape when viewed from the X direction), and it is possible to prevent an object placed on the horizontal stand 14 from falling easily even if the object is moved to the near side or the far side. It should be noted, however, that only one of the upper end of the second plate-shaped part 142 and the upper end of the second side plate 12 may extend higher than the first plate-shaped part 141 in a modified example.

As illustrated in FIG. 5B, the horizontal stand 14 extends at a height equal to or higher than a position at a predetermined height H3 from the floor surface. A space under the horizontal stand 14 functions as a storage space 70 (refer to FIG. 5B).

As illustrated in FIG. 5A and FIG. 5B, the storage space 70 is formed under the horizontal stand 14 when the furniture 1 is in the form of the bed. When the furniture 1 is in the form of the bed, it is possible for the main cushions 40 to be stored in the storage space 70 as illustrated in FIG. 5A. It should be noted that a part of the mattress 30 (the far side part) is inserted into under the horizontal stand 14 as illustrated in FIG. 4 when the furniture 1 is in the form of the sofa, and the storage space 70 also functions as a containing space of the part of the mattress 30.

It should be noted that the main cushions 40 may be stored by further utilizing a space 144 inside the horizontal stand 14 (refer to FIG. 5A). The space 144 inside the horizontal stand 14 is a space that is formed on the back sides (the storage space 70 sides that will be described later) of the first plate-shaped part 141 and the second plate-shaped part 142, and that is partitioned by the third plate-shaped part 143 in the X direction. In this case, by functioning together with the storage space 70, the space 144 inside the horizontal stand 14 forms a space in which the main cushions 40 can be stored. It should be noted that the height of the main cushions 40 (refer to "H5" in FIG. 7B) may be higher than the predetermined height H3 in the case where the main cushions 40 are stored by using the space 144 inside the horizontal stand 14.

The slide floor plate 20 is enabled to slide in the Y direction with respect to the body 10. The slide floor plate 20 is enabled to slide in the Y direction between a first position illustrated in FIG. 1 when the furniture 1 is in the form of the sofa (hereinafter, referred to as a "sofa position") and a second position illustrated in FIG. 2 when the furniture 1 is in the form of the bed (hereinafter, referred to as a "bed position"). The sofa position is on the far side relative to the bed position. It should be noted that "the slide floor plate 20 is enabled to slide between the sofa position and the bed position" does not necessarily mean that the slide floor plate 20 is enabled to slide only between the sofa position and the bed position. For example, in an embodiment of the present invention, as an example, the slide floor plate 20 is not enabled to slide toward the far side beyond the sofa position with respect to the body 10, but enabled to slide toward the near side beyond the bed position with respect to the body 10 (refer to FIG. 3). Therefore, in an embodiment of the present invention, the bed position corresponds to a position in the middle in the slide stroke of the slide floor plate 20.

The slide floor plate 20 overlaps the horizontal stand 14 in the top view (viewed in the Z direction) when the slide floor plate 20 is at the sofa position, as illustrated in FIG. 4. It should be noted that the part, in the slide floor plate 20, which overlaps the horizontal stand 14, is a part of the slide floor plate 20 on the far side (i.e., the part that is brought to under the horizontal stand 14). With the above arrangement, as will be described later, it is possible to realize a width that is appropriate as a sitting part of a sofa in the Y direction (depth size) by causing an effective width L1 of the mattress 30 in the Y direction which can be used as a sofa (refer to FIG. 4) to be significantly less than the entire width LO of the mattress 30 in the Y direction. It should be noted that, in FIG. 4, the slide floor plate 20 overlaps the horizontal stand 14 in the top view to the maximum extent. However, according to the user's preference, it may be possible for the less amount of the slide floor plate 20 to overlap the horizontal stand 14 in the top view to the maximum extent.

The slide floor plate 20 does not substantially overlap the horizontal stand 14 in the top view when the slide floor plate 20 is at the bed position, as illustrated in FIG. 5A and FIG. 5B. With the above arrangement, the storage space 70 is formed under the horizontal stand 14.

The mattress 30 is enabled to be placed on the slide floor plate 20. In other words, the mattress 30 is placed on the slide floor plate 20 when the furniture 1 is in use. In the following, unless otherwise mentioned in particular, a position relation of the mattress 30 with respect to another element refers to the position relation of the mattress 30 in a state in which the mattress 30 is placed on the slide floor plate 20. The mattress 30 has a rectangle outline corresponding to the slide floor plate 20 in the top view. In other words, the mattress 30 and the slide floor plate 20 have substantially the same rectangle outline in the top view. Typically, the mattress 30 and the slide floor plate 20 have a sufficient length in the X direction and a sufficient width L0 in the Y direction for a user to lie on. According to an embodiment of the present invention, as an example, corresponding to the size of a single bed, the mattress 30 and the slide floor plate 20 may have a length about 2 m in the X direction and a width about 1 m in the Y direction. Further, the length of the mattress 30 and the slide floor plate 20 in the X direction is substantially equal to a distance between the first side plates 11 on two sides, and the width L0 of the mattress 30 and the slide floor plate 20 in the Y direction is substantially equal to the length of the first side plates 11 in the Y direction.

An upper surface of the mattress 30 extends at a height lower than the lower end of the second plate-shaped part 142 of the horizontal stand 14. In other words, the height H4 of the upper surface of the mattress 30 is lower than the height (equal to the predetermined height H3) of the lower end of the second plate-shaped part 142 of the horizontal stand 14, as illustrated in FIG. 5A. With the above arrangement, a clearance Δ1 between the lower end of the second plate-shaped part 142 of the horizontal stand 14 and the upper surface of the mattress 30 is set (refer to FIG. 5A). With the above arrangement, it is possible for the slide floor plate 20 to slide between the sofa position and the bed position below the horizontal stand 14 without having the mattress 30 interfered with by the horizontal stand 14. For example, the clearance Δ1 may be set by taking into account a thickness amount of auxiliary mats, etc., that may be placed on the mattress 30. The clearance Δ1 may be, for example, about 8 cm.

When the furniture 1 is in the form of the sofa, the mattress 30 becomes a sitting part for the user who sits on the sofa. When the furniture 1 is in the form of the sofa, the mattress 30 may abut onto the second side plate 12 in the Y direction. With the above arrangement, for example, the movement of the mattress 30 toward the far side (slippage with respect to the slide floor plate 20) is prevented even when the user sits down on the mattress 30 vigorously.

Specifically, when the furniture 1 is in the form of the sofa, an end surface of the mattress 30 on the far side abuts onto the second side plate 12 in the Y direction. It should be noted that, at this time (i.e., when the slide floor plate 20 is at the sofa position), the end surface of the mattress 30 on the far side may be slightly away from (separated from) the second side plate 12 in the Y direction. When the furniture 1 is in the form of the sofa, the effective width L1 that can be used as a sofa in the mattress 30 (refer to FIG. 4) corresponds to a length obtained by subtracting the width L5 of the horizontal stand 14 in the Y direction from the width L0 of the mattress 30 in the Y direction. It should be noted that, in the present specification, unless otherwise specifically mentioned, "a first length corresponds to a second length" means that the first length is substantially equal to the second length, and that the lengths are related to each other. The effective width L1 is set in such a way that a distance L2 to an edge of the main cushions 40 on the near side in a state in which the main cushions 40 function as backrest cushions will provide comfortable sitting feelings to the user who sits on the sofa. For example, the effective width L1 may be set in such a way that the distance L2 becomes about 50 to 60 cm.

When the furniture 1 is in the form of the bed, the mattress 30 is a part that supports the whole body of the user who lies on the bed. When the furniture 1 is in the form of the bed, as illustrated in FIG. 5B, the mattress 30 is right next to the storage space 70 in the Y direction. In other words, when the furniture 1 is in the form of the bed, there exists no element related to the body 10 between the mattress 30 and the storage space 70 in the Y direction (refer to a comparative example illustrated in FIG. 8A, etc., as in contrast). Therefore, in a state in which the main cushions 40 are stored in the storage space 70, when the furniture 1 is in the form of the bed, the mattress 30 abuts onto the main cushions 40 in the Y direction as illustrated in FIG. 5A. In other words, the bed position corresponds to a position of the slide floor plate 20 when the mattress 30 on the slide floor plate 20 abuts onto (touches) the main cushions 40 in the storage space 70 in the Y direction.

When the furniture 1 is in the form of the bed, as illustrated in FIG. 5A, the effective width L4 of the mattress 30 (refer to FIG. 5A) that can be used as a bed corresponds to a length obtained by subtracting the width L5 of the horizontal stand 14 in the Y direction from a value obtained by adding, to the width L0 of the mattress 30 in the Y direction, a distance L6 from the mattress 30 to the second side plate 12 in the Y direction when the slide floor plate 20 is at the bed position (=L0+L6−L5). It is preferable that the effective width L4 be set in such a way that the effective width L4 becomes substantially equal to the width L0 of the mattress 30 in the Y direction. For example, the effective width L4 may be caused to be substantially equal to the width L0 of the mattress 30 in the Y direction by causing the width L5 of the horizontal stand 14 to be substantially equal to the width L3 of the main cushions 40 in the Y direction.

When the furniture 1 is in the intermediate state, as illustrated in FIG. 6, an entrance gap Δ2 (an example of a gap) is formed between the lower end of the second plate-shaped part 142 of the horizontal stand 14 and the upper surface of the mattress 30. The entrance gap Δ2 is set to a size that provides good workability related to storing the main cushions 40 in the storage space 70 and to taking out the main cushions 40 from the storage space 70. The slide stroke of the slide floor plate 20 is designed in such a way that an intermediate state is realized in which the entrance gap Δ2 becomes equal to or greater than the width L3 of the main cushions 40 in the Y direction.

When the furniture 1 is in the form of the sofa, as illustrated in FIG. 1, the main cushions 40 are enabled to be placed on the mattress 30 in a state in which the main cushions 40 abut onto the second plate-shaped part 142 of the horizontal stand 14 (the surface on the near side). In this state, the far sides of the main cushions 40 are supported by the second plate-shaped part 142 of the horizontal stand 14, and the main cushions 40 function as backrest cushions.

It is preferable that the main cushions 40 be formed by emphasizing (strengthening) functions as backrest cushions. For example, the main cushions 40 may include a part made of urethane material. Further, as illustrated in FIG. 1, the main cushions 40 extend between the first side plates 11 on two sides in the X direction. It should be noted that, in an embodiment of the present invention, as an example, two main cushions 40 are arranged next to each other in the X direction, and cover the whole space between the first side plates 11 on two sides in the X direction. Further, as illustrated in FIGS. 7A-7C, the main cushions 40 have a form in which the upper sides of the main cushions 40 are inclined toward the far side when viewed in the X direction. With the above arrangement, functions of the main cushions 40 as the backrest cushions are improved when compared with a case in which the main cushions 40 have substantially a rectangular form. Further, as illustrated in FIGS. 7A-7C, lower end surfaces 402 of the main cushions 40 are planar. With the above arrangement, it becomes easier to place the main cushions 40 on the mattress 30 in a stable position. It should be noted that, in the present specification, each size of the main cushions 40 (e.g., width L3 in the Y direction) refers to each size of the main cushions 40 in a position in which the lower end surfaces 402 are within the XY plane. It should be noted, however, that the main cushions 40 may be placed on the mattress 30 in a state in which the lower end surfaces 402 are inclined with respect to the upper surface of the mattress 30 (for example, the main cushions 40 may be placed on the mattress 30 in a state in which the main cushions 40 are inclined in such a way that only the near side edges of the lower end surfaces 402 of the main cushions 40 are in touch with the upper surface of the mattress 30).

As illustrated in FIGS. 7A-7C, the main cushions 40 have a height H5 that is necessary for improving functions as backrest cushions. In an embodiment of the present invention, as an example, as illustrated in FIG. 1, the main cushions 40 extend to a height higher than the horizontal stand 14 in a state in which the main cushions 40 function as backrest cushions. With the above arrangement, the horizontal stand 14 is hidden by the main cushions 40 when viewed from the near side, and thus, a good appearance is provided.

It is preferable that the main cushions 40 be made of the same outer fabric (surface material) as the mattress 30. The outer fabric may be, for example, fabric material, or may be genuine leather, synthetic leather, etc. With the above arrangement, sense of unity is created, and the merchantability is improved.

As described above, the main cushions 40 are enabled to be stored in the storage space 70 (refer to FIG. 5A). The main cushions 40 are enabled to be stored in the storage space 70 in a predetermined position. For example, the predetermined position is the same as a position when the main cushions 40 function as backrest cushions. More specifically, the main cushions 40 are stored in a position in which the lower end surfaces 402 are in surface contact with the floor surface in the Z direction. It should be noted, however, that, the main cushions 40 may be stored in a slightly modified position as illustrated in FIG. 5A depending on the bed position of the slide floor plate 20. Alternatively, the main cushions 40 may be stored in a state in which the lower end surfaces 402 are inclined with respect to the floor surface (for example, the main cushions 40 may be stored in a state in which the main cushions 40 are inclined in such a way that only the near side edges of the lower end surfaces 402 of the main cushions 40 are in touch with the floor surface). In the following, "main cushions 40 in a stored state" means the main cushions 40 in a state in which the main cushions 40 are stored in the storage space 70 in the predetermined position.

As illustrated in FIG. 5A, the width L3 of the main cushions 40 in the Y direction is substantially equal to the width L5 of the horizontal stand 14 in the Y direction (i.e., L3≈L5). "The width L3 is substantially equal to the width L5" means that L3 and L5 have a relationship that realizes a state in which the "main cushions 40 in a stored state" are stored substantially without excess space under the horizontal stand 14, and means that the difference between L3 and L5 is equal to or less than, for example, 15 mm. For example, the width L3 of the main cushions 40 in the Y direction may be about 10 mm less than the width L5 of the horizontal stand 14 in the Y direction. Further, as illustrated in FIG. 5A, the width L3 of the main cushions 40 in the Y direction is substantially equal to a distance L6 from the mattress 30 to the second side plate 12 in the Y direction when the slide floor plate 20 is at the bed position (i.e., L3≈L6). "The width L3 is substantially equal to the width L6" means that L3 and L3 have a relationship that realizes a state in which only the main cushions 40 are stored without excess space in the storage space 70 when the slide floor plate 20 is at the bed position. With the above arrangement, the distance L6 is not greater than necessary, and it is possible to prevent the size of the furniture 1 in the form of the bed in the Y direction from becoming greater than necessary.

Further, it is preferable that the height H5 of the main cushions 40 (refer to FIG. 5A) be significantly higher than the height H4 of the upper surface of the mattress 30. In this case, when viewed from the near side, the upper ends of the main cushions 40 in a stored state are visible through the clearance Δ1 (refer to FIG. 5A) between the lower end of the second plate-shaped part 142 of the horizontal stand 14 and the upper surface of the mattress 30, and thus, the appearance on the far side of the mattress 30 is improved when the furniture 1 is in the form of the bed. Specifically, in the case where the height H5 of the main cushions 40 is equal to or less than the height H4 of the upper surface of the mattress 30, when viewed from the near side, an empty space above the main cushions 40 in a stored state tends to become visible due to the clearance Δ1 between the lower end of the second plate-shaped part 142 of the horizontal stand 14 and the upper surface of the mattress 30. With respect to the above, in the case where the height H5 of the main cushions 40 is greater than the height H4 of the upper surface of the mattress 30, instead of the empty space, the upper ends of the main cushions 40 become visible, and thus, the appearance is improved. The improvement of the appearance becomes more significant in the case where the main cushions 40 and the mattress 30 are made of the same outer fabric (surface material). For example, the height H5 of the main cushions 40 may be greater than the height H4 of the upper surface of the mattress 30 by about 7 cm or more.

The size of the sub-cushions 50 is smaller than the size of the main cushions 40. The sub-cushions 50 can be used as pillows, etc. A plurality of the sub-cushions 50 may be provided. It should be noted that the sub-cushions 50 may be omitted in a modified example.

In an embodiment of the present invention, it may be possible for the user to use the furniture 1 by changing the form of the furniture 1 as described below.

When changing the form from the sofa to the bed, the user holds the near side of the slide floor plate 20 with hands and causes the slide floor plate 20 to widely slide to the near side as illustrated in FIG. 3. Further, as illustrated in FIG. 3, the user stores the main cushions 40, which are not necessary in the form of the bed, into the storage space 70 under the horizontal stand 14.

Next, the user causes the slide floor plate 20 to slide towards the far side to the bed position illustrated in FIG. 2. In this case, as illustrated in FIG. 5A, the slide floor plate 20 is caused to slide until the mattress 30 touches the main cushions 40 in the storage space 70. With the above operations, the slide work from the form of the sofa to the form of the bed is completed.

On the other hand, when changing the form from the bed to the sofa, the user holds the near side of the slide floor plate 20 with hands and causes the slide floor plate 20 to widely slide to the near side as illustrated in FIG. 3. Further, the user takes out the main cushions 40 in the storage space 70 under the horizontal stand 14.

Next, the user causes the slide floor plate 20 to slide towards the far side to the sofa position illustrated in FIG. 1. In this case, as illustrated in FIG. 4, the slide floor plate 20 is caused to slide until a floor plate lower crosspiece 220, which will be described later, abuts onto a side frame 113 in the Y direction. Further, the user places the main cushions 40 on the mattress 30 in a position illustrated in FIG. 1 (in a position in which the main cushions 40 function as backrest cushions). With the above operations, the slide work from the form of the bed to the form of the sofa is completed.

As described above, according to an embodiment of the present invention, with relatively simple operations, it is possible for the user to change the form of the furniture 1, from the form of the sofa to the form of the bed, or, from the form of the bed to the form of the sofa.

Further, according to an embodiment of the present invention, as described above, when the furniture 1 is in the form of the bed, the storage space 70, which is capable of storing the main cushions 40, is formed under the horizontal stand 14. Therefore, when the furniture 1 is in the form of the bed, it is possible to store the main cushions 40 in the formed storage space 70. Therefore, the user, who uses the furniture 1 in the form of the bed, has no problem with respect to a place in which the main cushions 40 are placed. It is not necessary for the user to separately secure a space for storage, which increases the convenience.

Further, according to an embodiment of the present invention, as described above, the horizontal stand 14 functions as a shelf. It is possible for the user to place an object on the horizontal stand 14, which increases the convenience.

Here, by using a comparative example, effects of an embodiment of the present invention will be further described.

Figure 8A:
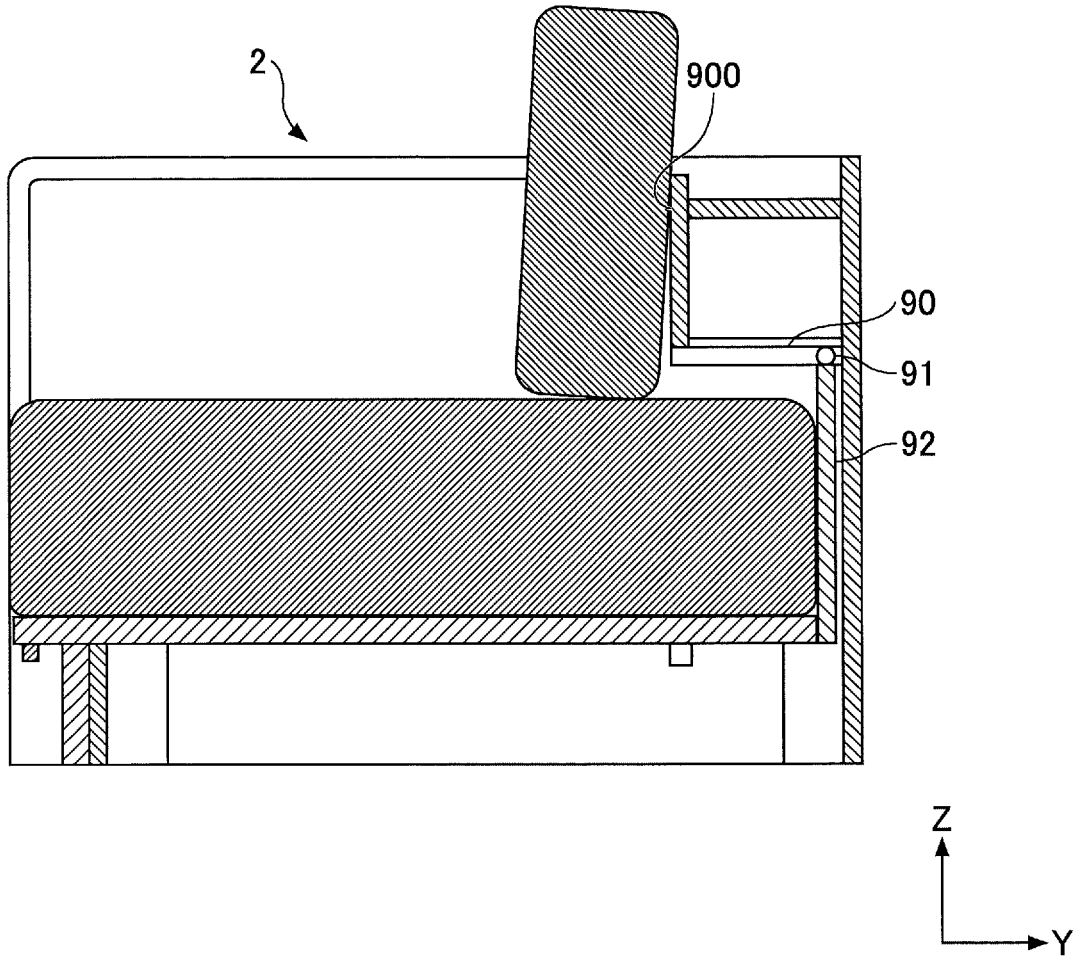
FIG. 8A is a schematic illustration of furniture according to a comparative example.
Figure 8B:
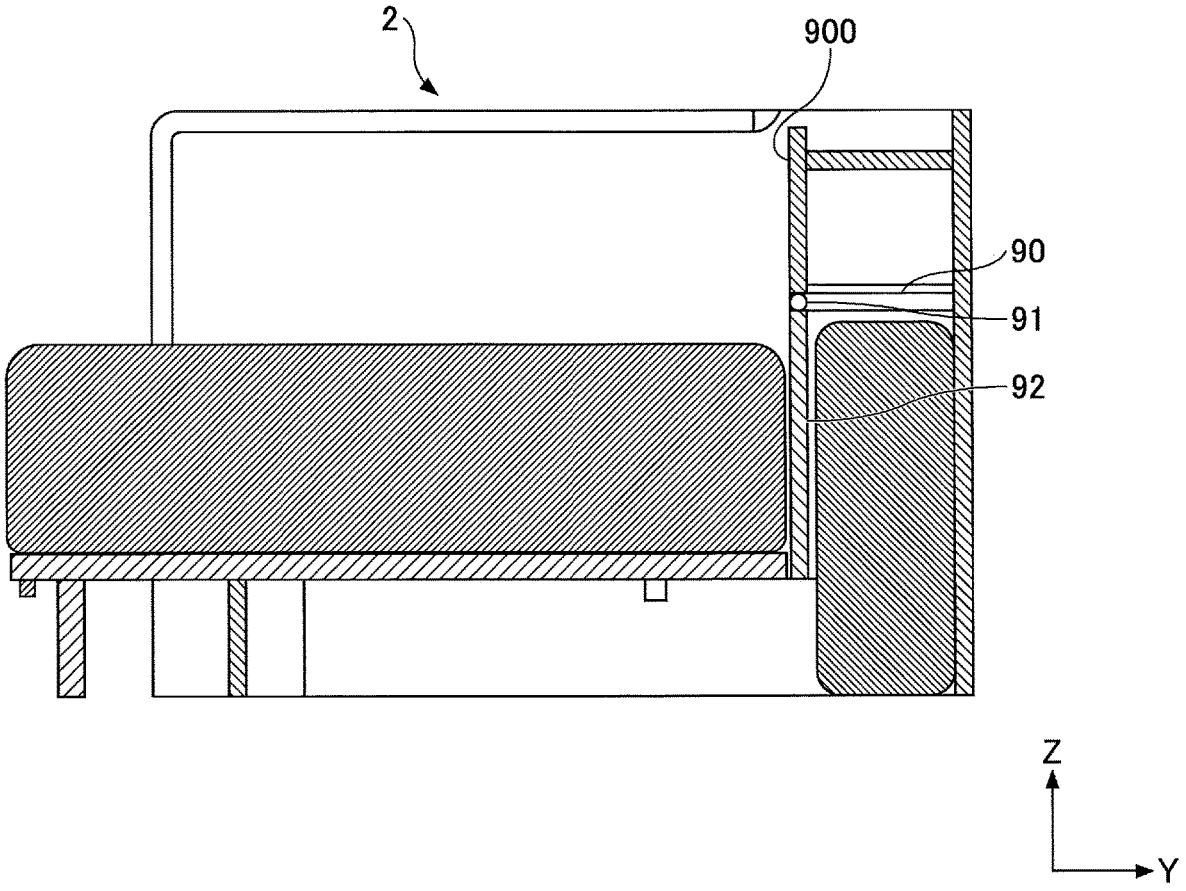
FIG. 8B is a schematic illustration of furniture according to a comparative example.
Figure 8C:
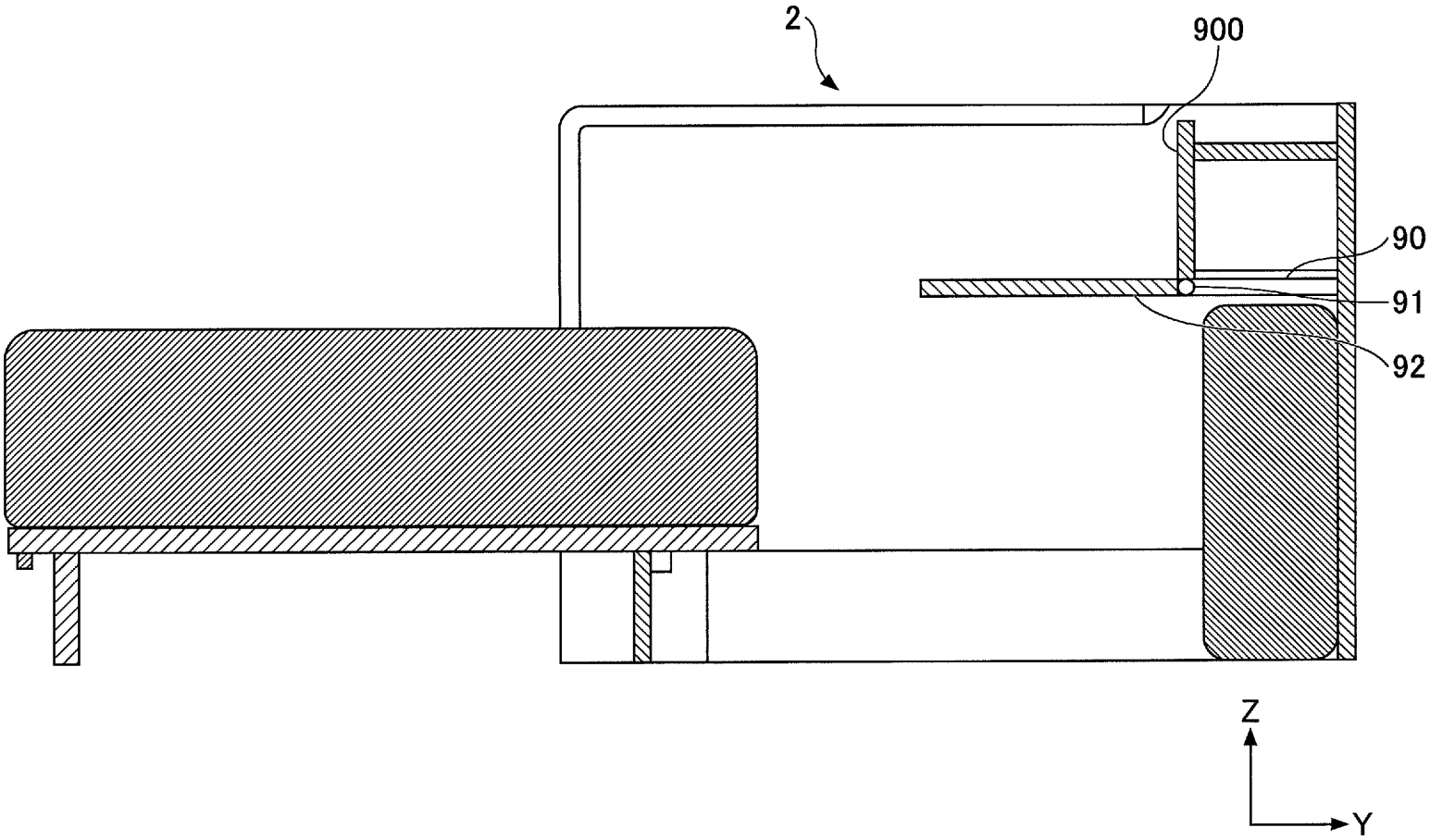
FIG. 8C is a schematic illustration of furniture according to a comparative example.

FIG. 8A through FIG. 8C are schematic drawings illustrating furniture 2 according to a comparative example, and are sectional views that can be compared with sectional views illustrated in FIG. 4, etc. The furniture 2 in the form of the sofa is illustrated in FIG. 8A. The furniture 2 in the form of the bed is illustrated in FIG. 8B. The furniture 2 in an intermediate state is illustrated in FIG. 8C.

In a comparative example, as illustrated in FIG. 8A through FIG. 8C, the side plate 900 of the horizontal stand includes a rail 90 in the Y direction at the lower end and an extended side plate 92 that further extends downwards. The extended side plate 92 is enabled to rotate around a rotation shaft 91 in the X direction. The rotation shaft 91 is enabled to slide on the rail 90 in the Y direction. Therefore, in the comparative example, as illustrated in FIG. 8A, it is possible for the furniture 2 to change to a form of the sofa by causing the extended side plate 92 to slide towards the far side, and, as illustrated in FIG. 8B, to change to a form of the bed in which main cushions are stored under the horizontal stand by causing the extended side plate 92 to slide towards the near side.

In the comparative example, the extended side plate 92 of the side plate 900 of the horizontal stand is a movable part, and thus, the structure becomes relatively complicated. In other words, the structure is relatively complicated due to a mechanism (e.g., the rail 90, the rotation shaft 91, etc.) that enables the extended side plate 92 to slide and rotate. Therefore, the number of parts will be increased and the costs will be increased. Furthermore, it becomes difficult to secure a space under the horizontal stand (e.g., a space for storing the main cushions used for backrest cushions). For example, in an example illustrated in FIG. 8A through FIG. 8C, in order to have the size of the furniture 2 in the Y direction the same as that of the furniture 1, and, at the same time, in order to have the size of the space under the horizontal stand the same as that of the furniture 1, it is necessary to reduce the width of the mattress in the Y direction by the thickness amount of the extended side plate 92. This means that the size of the furniture 2 in the Y direction must be increased in order to enable the furniture 2 to place a mattress with the same size as that of the furniture 1 in the Y direction. Further, as schematically illustrated in FIG. 8C, when storing and taking out the main cushions, it is necessary to allow the extended side plate 92 to rotate towards the near side to a near horizontal angle, and thus, the pulling out amount of the slide floor plate and the mattress towards the near side becomes relatively greater.

With respect to the above, according to an embodiment of the present invention, compared with the comparative example, the structure is relatively simple and it is advantageous in view of the number of parts and costs. Further, it is possible to cause the width of the furniture 1 in the form of the bed in the Y direction to be efficiently smaller by not requiring the extended side plate 92. It is possible to prevent from increasing the size of the furniture 1 greater than necessary. Furthermore, in order to secure the entrance gap Δ2 that is required when storing and taking out the main cushions, it is only necessary to pull out the slide floor plate 20 by a minimum distance (it is not necessary to allow the extended side plate 92 to rotate, which is required in the comparative example). Therefore, the work space can be smaller and the workability is better.

Next, referring to FIG. 9 through FIG. 15B and referring to the above-described FIG. 4 and FIG. 5A, the body 10 and the slide floor plate 20 of the furniture 1 will be further described. In the following, in the furniture 1, the combination of the body 10 and the slide floor plate 20 is referred to as a "bed-sofa body".

Figure 9:
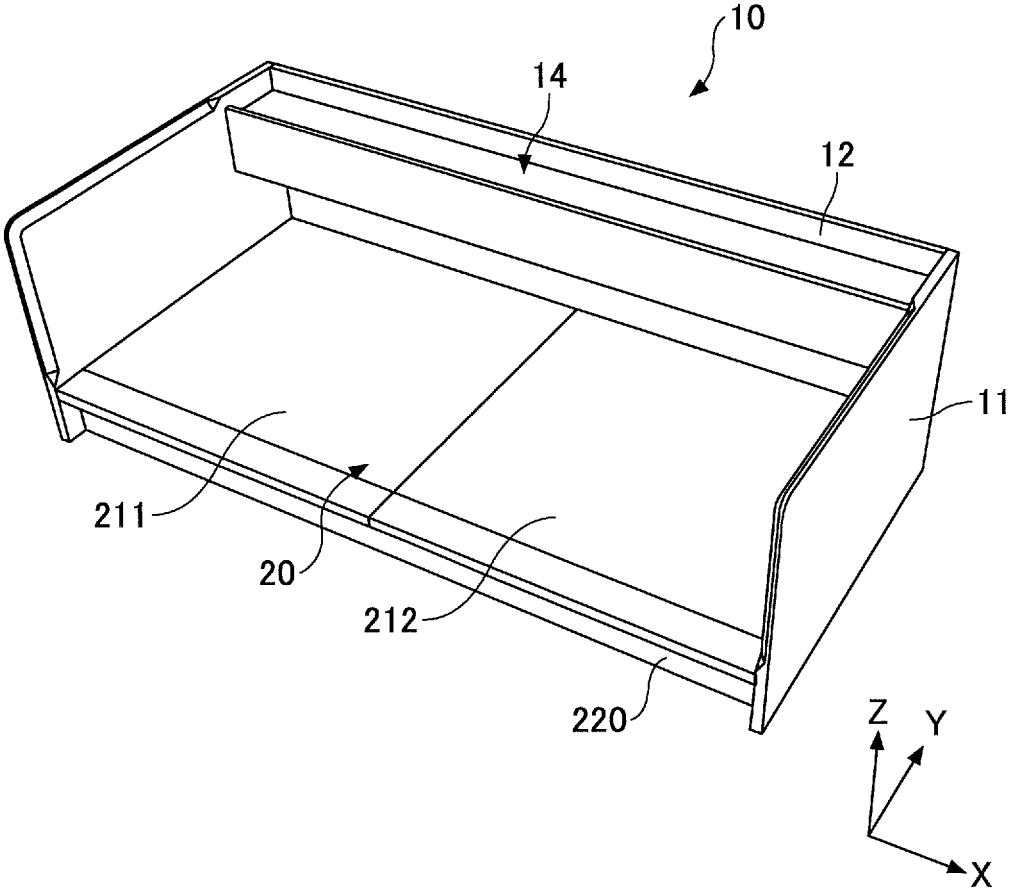
FIG. 9 is a perspective view of a bed-sofa body.
Figure 10:
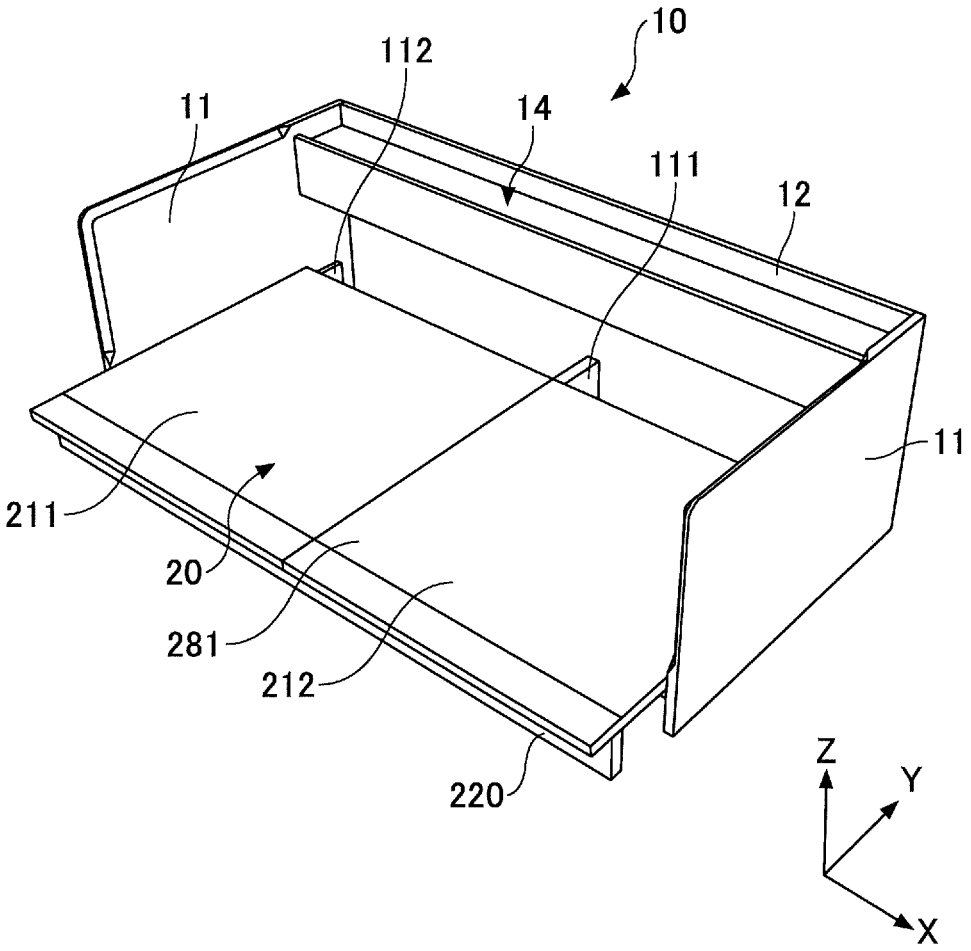
FIG. 10 is a perspective view of a bed-sofa body.
Figure 11:
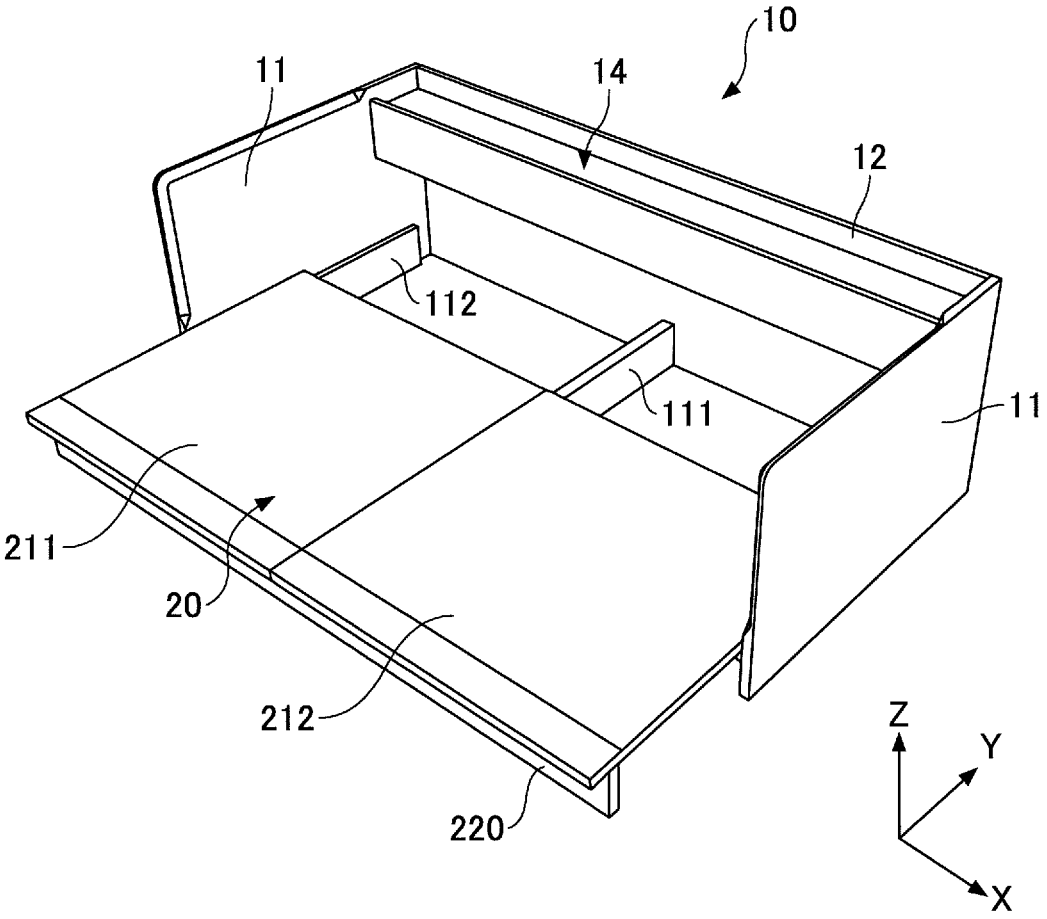
FIG. 11 is a perspective view of a bed-sofa body.
Figure 12:
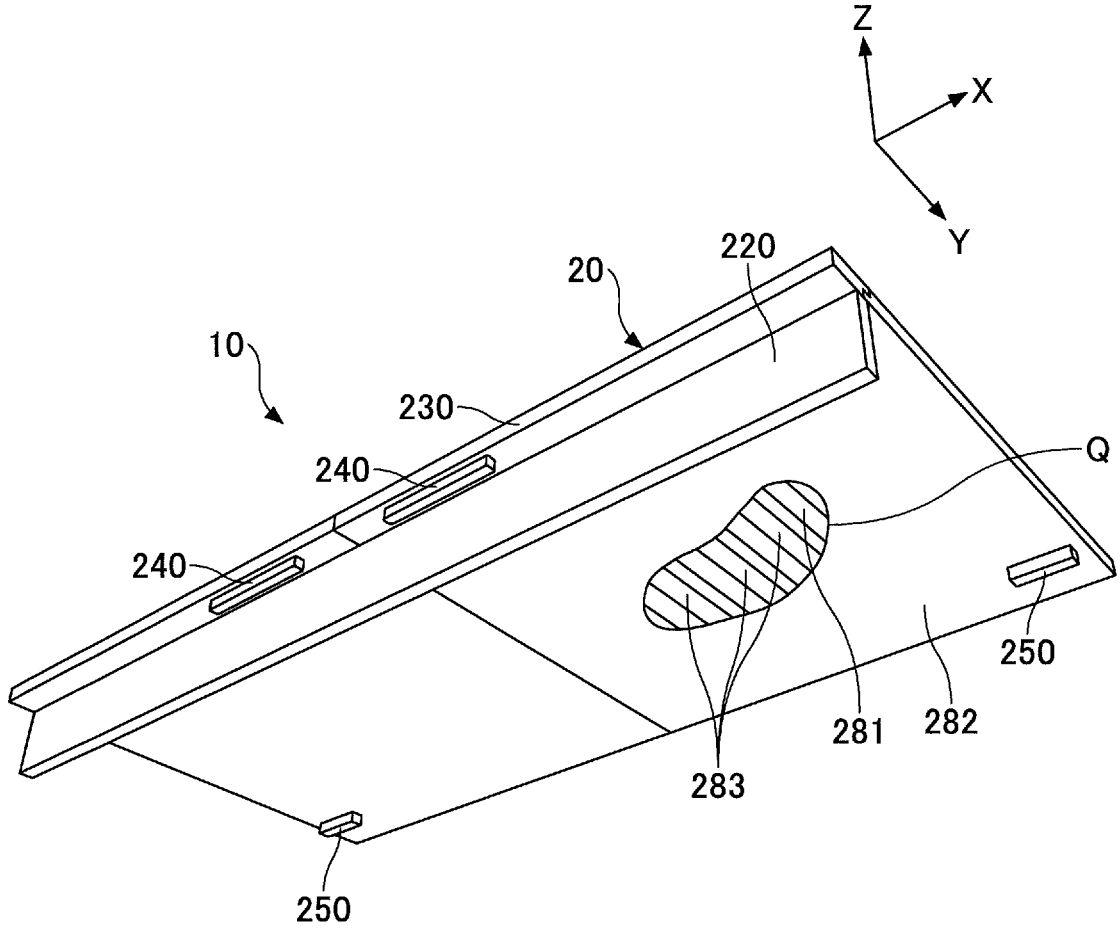
FIG. 12 is a perspective view viewing the lower side of a slide floor plate.
Figure 13A:
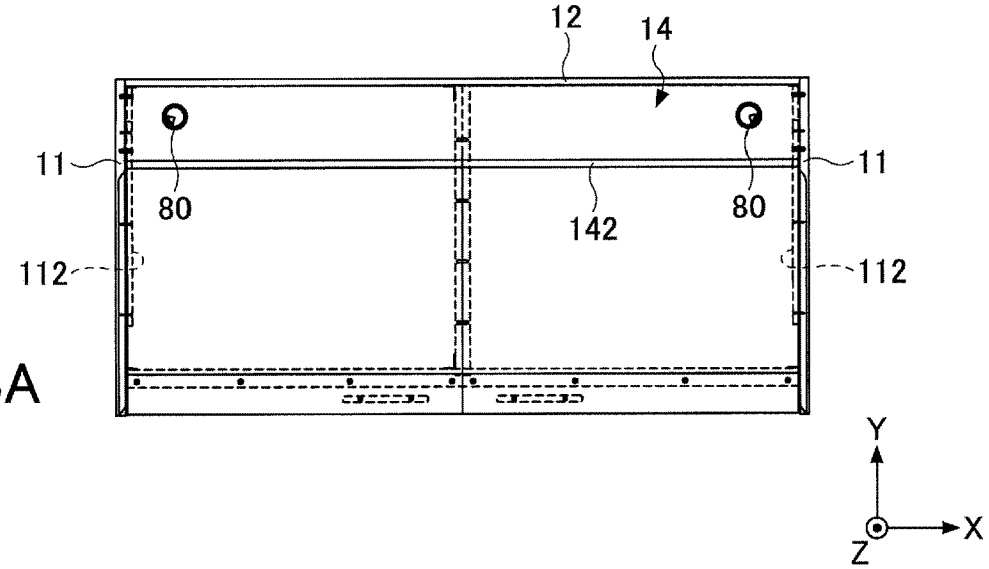
FIGS. 13A-13C are three-sided views illustrating details of the bed-sofa body.
Figure 13B:
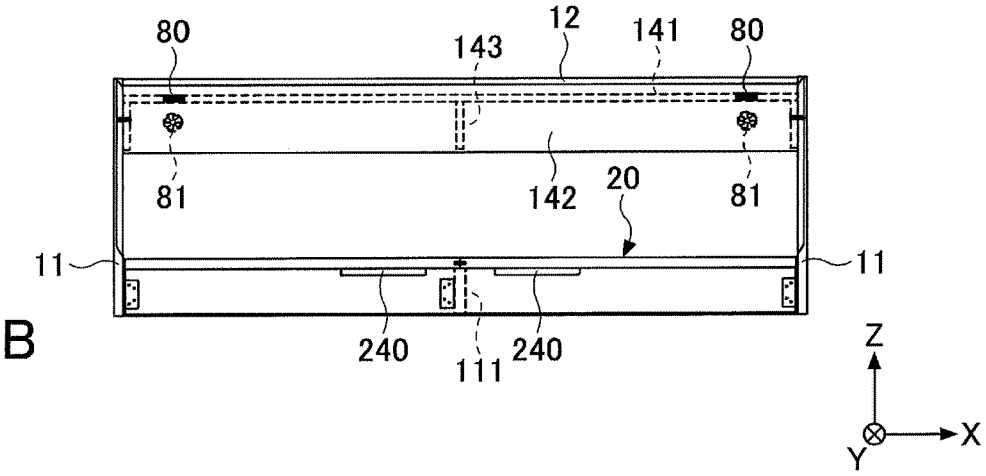
Figure 13C:
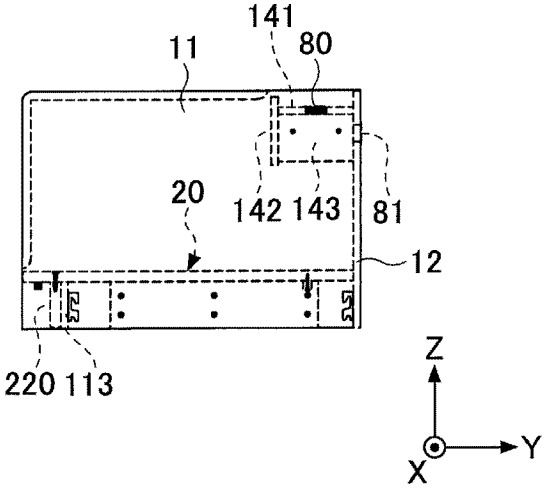
Figure 14:
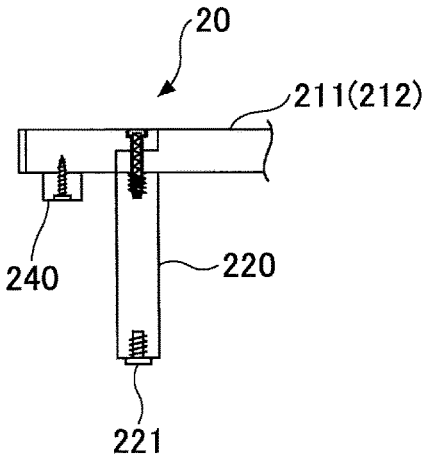
FIG. 14 is a drawing illustrating a near side part of the slide floor plate.
Figure 15A:
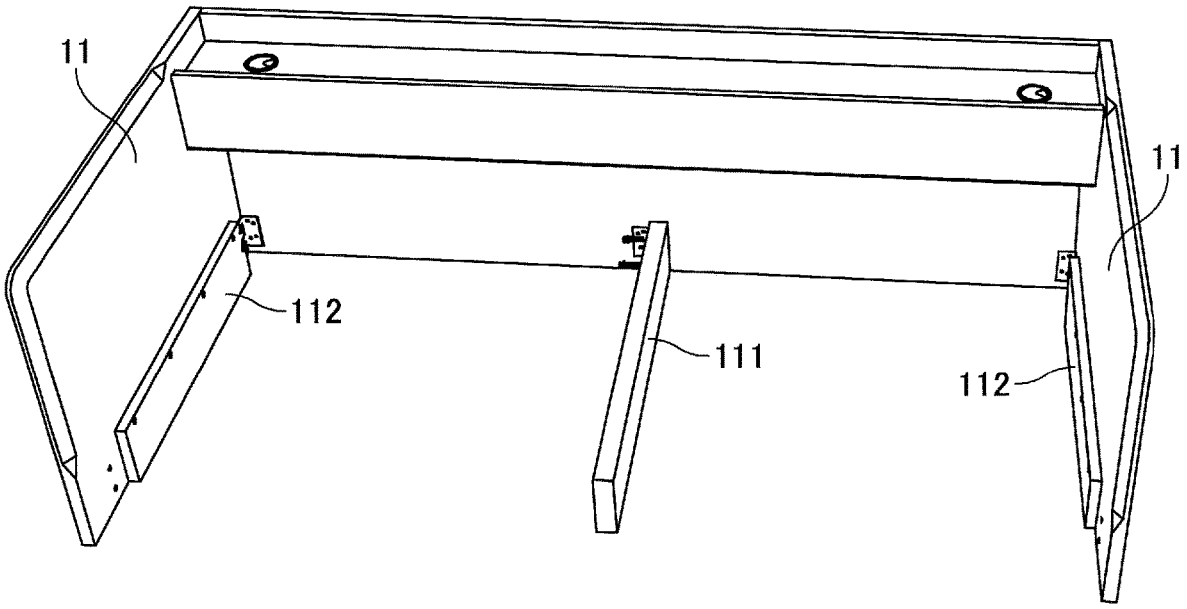
FIG. 15A is a drawing illustrating the body partially disassembled.
Figure 15B:
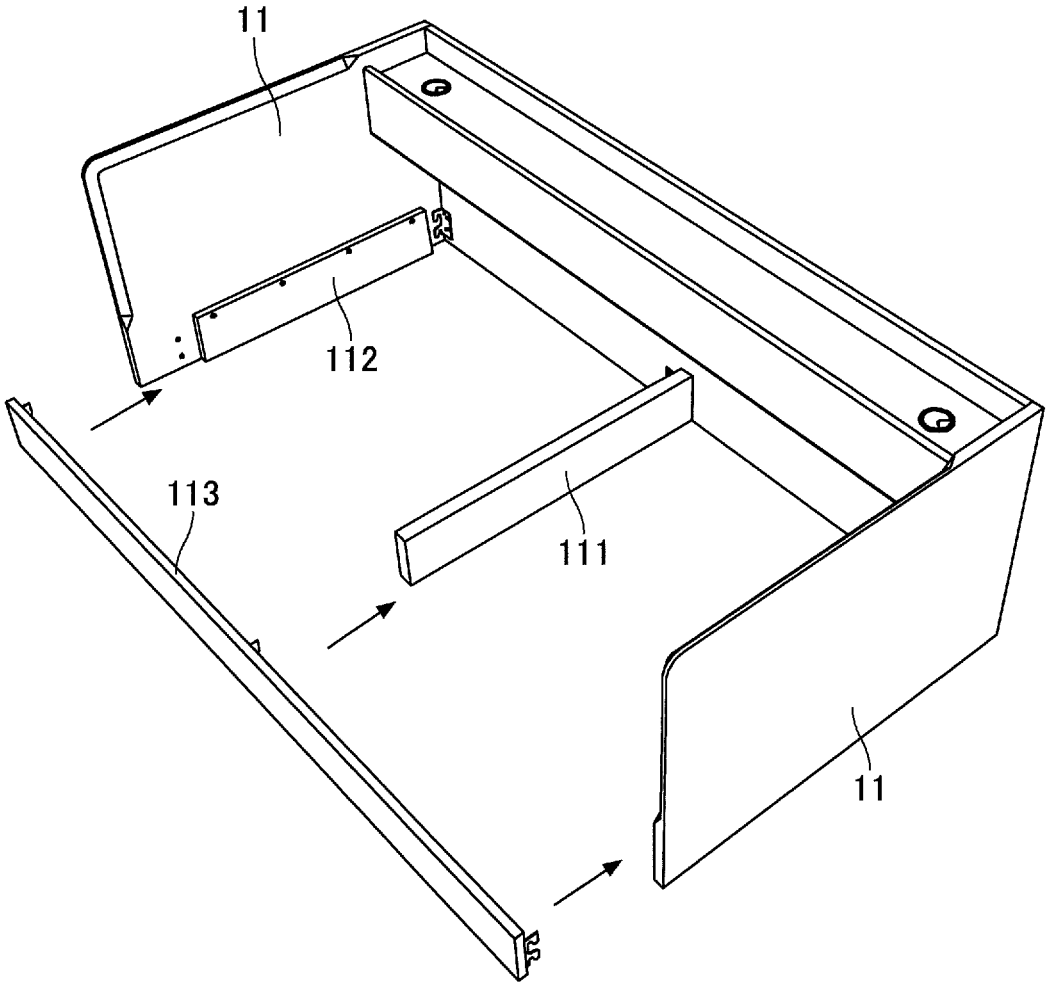
FIG. 15B is a drawing illustrating the body partially disassembled.

FIG. 9 through FIG. 11 are perspective views of the bed-sofa body. FIG. 12 is a perspective view viewing the lower side of the slide floor plate 20. FIGS. 13A-13C are three-sided views illustrating details of the bed-sofa body. FIG. 14 is a drawing illustrating a near side part of the slide floor plate 20. Further, FIG. 15A and FIG. 15B are drawings illustrating the body 10 that is partially disassembled. It should be noted that, in FIG. 15B, as a reference, the direction for assembling a side frame 113 is indicated by arrows. It should be noted that FIG. 9 through FIG. 11 are schematic drawings. Some of the elements illustrated in the detailed drawings of FIGS. 13A-13C, etc., are omitted in FIG. 9 through FIG. 11. Further, in FIG. 12, in order to illustrate an inner structure of the slide floor plate 20, a part Q, in which a part of a lower side plate element 282 of the slide floor plate 20 is cut through, is illustrated. Further, in FIG. 14, for the sake of description convenience, screws, or the like, are illustrated in a transparent view.

As illustrated in FIG. 9 through FIG. 11, the body 10 supports the slide floor plate 20 in such a way that the slide floor plate 20 is enabled to slide. Specifically, the body 10 includes a middle divider 111 (an example of a first support element), side support elements 112 (an example of a second support element) that are attached to the first side plates 11 on two sides, and a side frame 113 (an example of a third support element).

As illustrated in FIG. 11 and FIG. 15A, the middle divider 111 extends in the Y direction. The middle divider 111 is provided at a center position between the first side plates 11 on two sides in the X direction. In an embodiment of the present invention, as an example, when viewed in the X direction, the middle divider 111 extends towards the far side to the second side plate 12, and extends towards the near side to a point that is on the far side relative to the near side edge of the first side plate 11. The middle divider 111 is fixed to the second side plate 12 via a bolt, or the like. Therefore, the middle divider 111 partitions the lower side of the above-described storage space 70 into two sections with predetermined lengths in the X direction. It is preferable that the predetermined lengths be the same. In an embodiment of the present invention, the predetermined length is a half of a distance between the first side plates 11 on two sides in the X direction. In each of the sections obtained by partitioning the lower side of the storage space 70 by the middle divider 111, corresponding one of the two main cushions 40 is stored. It should be noted that a plurality of the middle dividers 111 may be provided at different positions in the X direction in a modified example.

As described above, the middle divider 111 partitions the lower side of the storage space 70 into two sections with the predetermined lengths in the X direction. Therefore, when one middle divider 111 is provided, there are two main cushions 40, and when two middle dividers 111 are provided, there are three main cushions 40. In this way, the number of the main cushions 40 is greater than the number of the middle dividers 111 by one. The length of the main cushions 40 in the X direction corresponds to the predetermined length. With the above arrangement, a storing position of each of the main cushions 40 will become clear, and thus, the storage work of the main cushions 40 becomes easier.

The middle divider 111 supports a lower surface of the slide floor plate 20 in such a way that the slide floor plate 20 is enabled to slide. For example, the middle divider 111 is made of squared timber (rectangle plate material) whose section surface is rectangle. The middle divider 111 supports the slide floor plate 20 in such a way that the slide floor plate 20 is enabled to slide in a state in which an upper surface of the middle divider 111 is in surface contact with the lower surface of the slide floor plate 20. With the above arrangement, a supporting part is formed other than the two sides in the X direction, and thus, supporting capabilities of the body 10 for the slide floor plate 20 are increased.

For example, as illustrated in FIG. 15A, the side support elements 112 are fixed to the first side plates 11 via bolts, or the like. The side support elements 112 extend in parallel with the middle divider 111 in the Y direction. When viewed in the X direction, the side support elements 112 extend towards the far side and end at points on the near side relative to the second side plate 12, and extend towards the near side and end at points on the far side relative to the near side edge of the first side plate 11.

The side support elements 112 support the lower surface of the slide floor plate 20 in such a way that the slide floor plate 20 is enabled to slide. For example, the side support elements 112 are made of squared timber whose section surface is rectangle. The side support elements 112 support the slide floor plate 20 in such a way that the slide floor plate 20 is enabled to slide in a state in which upper surfaces of the side support elements 112 are in surface contact with the lower surface of the slide floor plate 20.

As illustrated in FIG. 15B, the side frame 113 extends in the X direction. Similar to the horizontal stand 14, the side frame 113 extends between the first side plates 11 on two sides in the X direction. The side frame 113 is fixed to the first side plates 11 at the ends of the side frame 113 on two sides in the X direction, respectively, via bolts, or the like. Further, the side frame 113 is fixed to the near side end of the middle divider 111 via a bolt, or the like. With the above arrangement, the middle divider 111, the side support elements 112, and the side frame 113 are connected to form parallel crosses, which increases the rigidity of the support parts of the body 10 (support parts of the slide floor plate 20) as a whole.

As described above, according to an embodiment of the present invention, the body 10 supports the slide floor plate 20 in such a way that the slide floor plate 20 is enabled to slide. Therefore, the slide work of the slide floor plate 20 by the user becomes easier compared with a structure in which the entire slide floor plate 20 slides on the floor surface. As the structure in which the entire slide floor plate 20 slides on the floor surface, for example, a structure can be listed in which the middle divider 111, the side support elements 112, and the side frame 113 are included in the slide floor plate 20. With this structure, the weight of the slide floor plate becomes heavier, the sliding resistance increases accordingly, and the load of slide work of the slide floor plate for the user increases. On the other hand, according to an embodiment of the present invention, the middle divider 111, the side support elements 112, and the side frame 113 are included in the body 10. With this structure, the weight of the slide floor plate 20 is relatively lighter, and the slide work of the slide floor plate 20 becomes easier for the user. Therefore, for example, the relatively low sliding resistance can be realized without including a friction reducing unit (e.g., roller) between the slide floor plate 20 and the support elements (the middle divider 111, the side support elements 112, and the side frame 113). It should be noted, however, that the friction reducing unit may be included, and that a part or all of the middle divider 111, the side support elements 112, and the side frame 113 may be included in the slide floor plate 20.

Further, as illustrated in FIGS. 13A-13C, the body 10 has a hole 81 for wiring in the second side plate 12, and has a hole 80 for wiring in the first plate-shaped part 141 of the horizontal stand 14. As described above, in an embodiment of the present invention, the horizontal stand 14 functions as a shelf, on which electric devices including lighting equipment, or the like, that require wiring can be placed. Therefore, it is possible for the user to route the electric codes of the electric devices via the holes 80 and 81. With the above arrangement, the routing of the electric codes with good appearance becomes easier.

As illustrated in FIG. 9 through FIG. 11, for example, the slide floor plate 20 may be formed by connecting two slide floor plate parts 211 and 212 in the X direction. With the above arrangement, the transport of the furniture 1 before assembly becomes easier. For example, the two slide floor plate parts 211 and 212 are formed symmetrically in the X direction.

As schematically illustrated in FIG. 12, the slide floor plate 20 includes an upper plate element 281, a lower plate element 282, and reinforcing elements 283. The reinforcing elements 283 are made of, for example, squared timber whose section surface is rectangle, and extend in the Y direction. The reinforcing elements 283 are provided between the upper plate element 281 and the lower plate element 282 in the up-and-down direction, and are connected to the upper plate element 281 and the lower plate element 282. The reinforcing elements 283 are made of squared timber whose section surface is rectangular, and a plurality of the reinforcing elements 283 are provided. With the above arrangement, it is possible to efficiently increase rigidity of the slide floor plate 20.

As illustrated in FIG. 12, the slide floor plate 20 includes, on the lower surface, the floor plate lower crosspiece 220 (an example of a fourth support element) that extends in parallel with the second side plate 12. The floor plate lower crosspiece 220 extends in the X direction. The floor plate lower crosspiece 220 extends covering the whole width of the slide floor plate 20 in the X direction. As illustrated in FIG. 14, the floor plate lower crosspiece 220 is fixed to the slide floor plate parts 211 and 212 of the slide floor plate 20 via bolts, or the like. As illustrated in FIG. 12, the floor plate lower crosspiece 220 is provided at a position shifted towards the far side with respect to the near side edge 230 of the slide floor plate 20.

As illustrated in FIG. 14, adjusters 221 may be attached to the lower end surface of the floor plate lower crosspiece 220. The adjusters 221 are used for adjusting the height from the floor surface to the lower end surface of the floor plate lower crosspiece 220. It should be noted that the lower end surface of the floor plate lower crosspiece 220 may be adjusted to be at a position slightly higher than the floor surface.

The floor plate lower crosspiece 220 functions as a stopper that determines the far side limit position of the slide stroke of the slide floor plate 20 (i.e., sofa position). Specifically, as illustrated in FIG. 4 and FIG. 5A, when the slide floor plate 20 is slid from the bed position illustrated in FIG.

5A towards the far side, the floor plate lower crosspiece 220 abuts onto the side frame 113 of the body 10 in the Y direction, and it becomes impossible for the slide floor plate 20 to slide further towards the far side. In this way, working together with the side frame 113, the floor plate lower crosspiece 220 functions as a stopper for stopping the sliding of the slide floor plate 20 towards the far side with respect to the body 10 at the sofa position. It should be noted that, at this time, the far side end surface of the slide floor plate 20 may be slightly separated in the Y direction with respect to the second side plate 12.

As illustrated in FIG. 12, the slide floor plate 20 includes convex parts 240 on the lower surface of the slide floor plate 20 at a position on the near side relative to the floor plate lower crosspiece 220. The convex parts 240 function as handles at the time of slide work (handles that are held by the user). In other words, it is possible for the user to move the slide floor plate 20 towards the near side and towards the far side by holding the convex parts 240. With the above arrangement, the workability of the slide operation of the slide floor plate 20 will be improved.

As illustrated in FIG. 12, the slide floor plate 20 includes a stopper 250, on the lower surface of the slide floor plate 20, that protrudes downwards. The stopper 250 abuts onto the side frame 113 of the body 10 in the Y direction when the slide floor plate 20 is caused to slide towards the near side, and stops the further sliding of the sliding floor plate 20 towards the near side. A position of the slide floor plate 20 at which the stopper 250 abuts onto the side frame 113 in the Y direction (a position with respect to the body 10) is referred to as "pulling-out limit position" (an example of a third position). In this way, working together with the side frame 113, the stopper 250 functions as a stopper for stopping the sliding of the slide floor plate 20 towards the near side with respect to the body 10 at the pulling-out limit position. With the above arrangement, it is possible to prevent the slide floor plate 20 from being pulled out by the user more than necessary.

Here, the pulling-out limit position is on the near side relative to the bed position. Further, the pulling-out limit position may be the same as a position at which the entrance gap Δ2 is formed, that is, a position of the slide floor plate 20 in an intermediate state illustrated in FIG. 3 (with respect to the body 10), or may be a position at which a gap greater than the entrance gap Δ2 is formed.

Next, an inner structure of the mattress 30 according to an embodiment of the present invention will be described.

It is preferable that the mattress 30 be a mattress with a built-in spring coil, and that the mattress 30 include a part of urethane material above the spring coil. Further, the mattress 30 does not include a metal wire that surrounds a corner of the mattress 30. By having the built-in spring coil, compared with a type of mattress that does not have a built-in spring coil, it is possible for the mattress 30 to provide more comfortable sleeping experience. Usually, the sitting feelings will be degraded when a mattress with a built-in spring coil is used in the form of the sofa, and the knee load of the user tends to increase. However, by including the part of urethane material above the spring coil, it is possible for the mattress 30 to reduce the degraded sitting feelings caused by the spring coil, other metal wires, etc. As a result, it is possible to improve not only the sleeping experience but also the sitting feelings.

Figure 16:
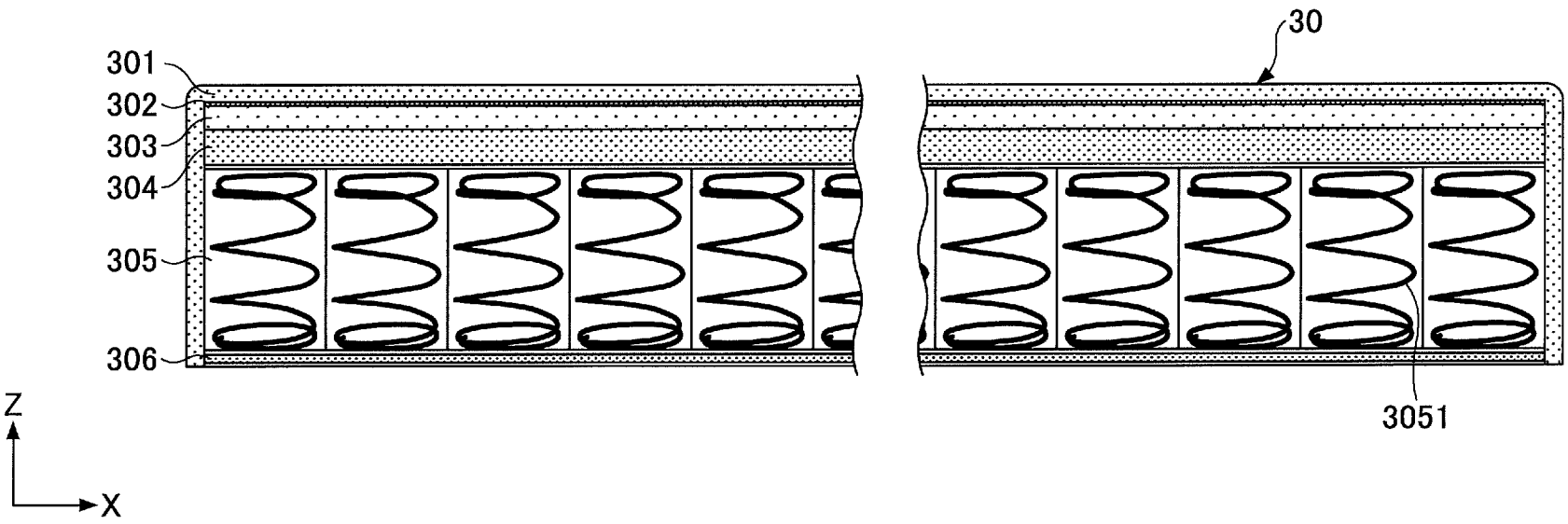
FIG. 16 is a sectional view illustrating an internal structure of a mattress.

FIG. 16 is a sectional view schematically illustrating an internal structure of the mattress 30. It should be noted that FIG. 16 illustrates the sectional view in the XZ plane. A sectional view in the YX plane is substantially the same as the sectional view in the YZ plane.

As illustrated in FIG. 16, the mattress 30 includes an outer fabric layer 301, a first upper layer 302, a second upper layer 303, a third upper layer 304, a coil layer 305, and a bottom layer 306, in this order from the top. It should be noted that the outer fabric layer 301 covers not only the upper side of the body of the mattress 30 but also the side surfaces. It should be noted that the thickness of the mattress 30 (the size in the up-and-down direction) is, for example, about 190 mm.

The coil layer 305 includes spring coils 3051. The spring coils 3051 is, for example, in the form of pocket coils. An arrangement method is, for example, a parallel arrangement, or may be an alternating arrangement.

Figure 17:
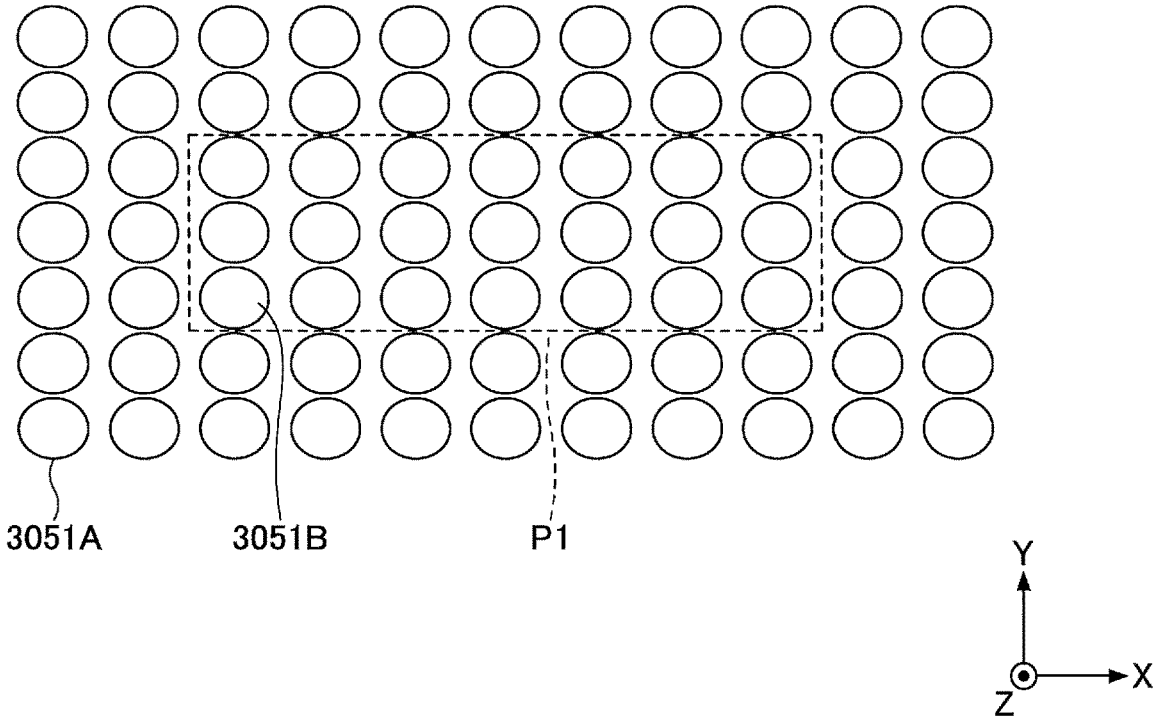
FIG. 17 is a schematic drawing illustrating a coil arrangement of a coil layer.

FIG. 17 is a schematic drawing illustrating a coil arrangement of the coil layer 305. FIG. 17 is a drawing schematically illustrating the arrangement of the spring coils 3051 in the top view.

In an example illustrated in FIG. 17, the coil layer 305 includes the spring coils 3051 with the parallel arrangement. The spring coils 3051 include two types of spring coils 3051A and 3051B. An arrangement range of the spring coils 3051A is outside of a range P1 illustrated in FIG. 17, and an arrangement range of the spring coils 305B is inside of the range P1 illustrated in FIG. 17. In other words, the spring coils 3051B are arranged in the center portion, and the spring coils 3051A are arranged in the circumference portion.

Regarding the spring coils 3051A, for example, the wire diameter (steel wire diameter) is 2.2 mm, the coil diameter is 62 mm, the coil height is 170 mm in free length and 130 mm when contained in a pocket, and the number of turns is 5.

Regarding the spring coils 3051B, for example, the wire diameter (steel wire diameter) is 1.8 mm, the coil diameter is 62 mm, the coil height is 170 mm in free length and 130 mm when contained in a pocket, and the number of turns is 5.

In this way, it is possible to provide not only the improved sleeping experience but also the improved sitting feelings by using two types of the spring coils 3051A and 3051B and by arranging the spring coils 3051B, whose wire diameter is smaller (i.e., the spring coefficient is lower), in the center portion.

Figure 18:
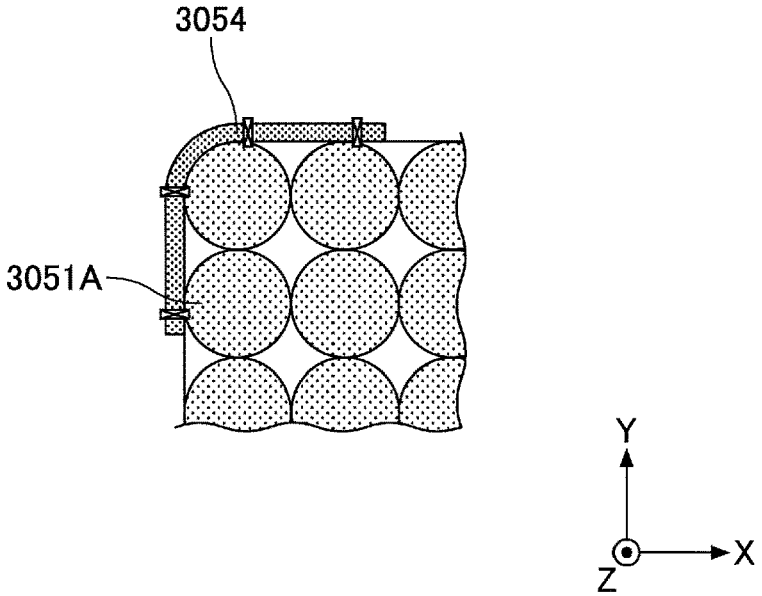
FIG. 18 is a drawing illustrating a detailed example of a structure of a corner of the circumference of the coil layer.

FIG. 18 is a drawing illustrating a detailed example of a structure of a corner of the circumference of the coil layer 305. FIG. 18 is a section view in case of cutting with the XY plane.

An reinforcement part 3054 is provided at the corner of the circumference of the coil layer 305. The reinforcement part 3054 is made of urethane material. It should be noted that the reinforcement part 3054 may be further covered by a cover made of urethane material. With the above arrangement, compared with a case in which the reinforcement part 3054 is made of metal, load of the knee of the user can be reduced and the sitting feelings can be improved.

Next, referring to Table 1, compositions of the outer fabric layer 301, the first upper layer 302, the second upper layer 303, the third upper layer 304, and the bottom layer 306 will be described.

Table 1 illustrates examples of the outer fabric layer 301, the first upper layer 302, the second upper layer 303, the third upper layer 304, and the bottom layer 306. It should be noted that it is assumed that, in Table 1, the unit of density is g/m$^2$ and the unit of thickness is mm. Further, it is assumed that the urethane related density "D ( represent values)" means "**kg/m$^3$". Further, in Table 1, "layer structure" denotes a layer structure in a case in which a layer includes a plurality of sub-layers. When a position of a sub-layer is higher in the table, the physical position of the sub-layer is higher in the layer.

TABLE 1

| LAYER (FROM TOP) | LAYER STRUCTURE | MATERIAL | DENSITY | THICKNESS |
|---|---|---|---|---|
| OUTER FABRIC 301 | FIRST LAYER | FABRIC | 180 | 1 |
| | SECOND LAYER | ARTIFICIAL COTTON | 70 | 5 |
| | THIRD LAYER | SOFT URETHANE | D21 | 5 |
| | FOURTH LAYER | NON-WOVEN FABRIC | 40 | 0.25 |
| FIRST UPPER LAYER 302 | SINGLE LAYER | NON-WOVEN FABRIC | 40 | 0.25 |
| SECOND UPPER LAYER 303 | SINGLE LAYER | SOFT URETHANE | D21 | 20 |
| THIRD UPPER LAYER 304 | SINGLE LAYER | HARD URETHANE | D28 | 25 |
| BOTTOM LAYER 306 | FIRST LAYER | NEEDLE PUNCH | 230 | 2.5 |
| | SECOND LAYER | NON-WOVEN FABRIC | 120 | 0.25 |

It should be noted that a non-woven fabric layer may be provided between the coil layer 305 and the third upper layer 304 (not shown in Table 1). Similarly, a non-woven fabric layer may be provided between the coil layer 305 and the bottom layer 306. In this case, regarding the non-woven layer, for example, the density may be 80 g/m2, and the thickness may be 0.25 mm.

As described above, according to an embodiment of the present invention, the mattress 30 includes a part of urethane material above the coil layer 305 (e.g., the outer fabric layer 301, the second upper layer 303, the third upper layer 304), and thus, it is possible to provide not only the improved sleeping experience by the spring coils, but also the improved sitting feelings by the part of urethane material. Further, according to an embodiment of the present invention, metal materials are not used for the corner of the circumference of the coil layer 305, and thus, it becomes possible to roll up the mattress 30. For example, ease of storage and portability of the mattress 30 are improved by rolling up the mattress 30 in such a way that the X direction becomes the circumferential direction.

As described above, embodiments according to the present invention have been described. An embodiment according to the present invention is not limited to the above described embodiments. Various modifications and variations may be possible within the range of the subject matter of the present invention recited in the claims. Further, it is possible to combine all or a part of the elements described in the embodiments.

For example, in an embodiment of the present invention described above, at the bed position, the mattress 30 abuts onto the main cushions 40 in the Y direction, which is not limited to this. For example, in the case where the outer shape of the slide floor plate 20 is larger than the outer shape of the mattress 30, at the bed position, the slide floor plate 20 may abut onto the main cushions 40 in the Y direction. In other words, the bed position may correspond to a position of the slide floor plate 20 when the slide floor plate 20 abuts onto (touches) the main cushions 40 in the storage space 70 in the Y direction.

The present application is based on and claims the benefit of priority of Japanese Priority Application No. 2017-084054 filed on Apr. 20, 2017, the entire contents of which are hereby incorporated herein by reference.

What is claimed is:

1. A furniture comprising:

a body including first side plates on two sides in a first direction, a second side plate on a first side in a second direction that is perpendicular to the first direction and to an up-and-down direction, and a horizontal stand that forms a horizontal surface extending from the second side plate towards a second side that is opposite to the first side in the second direction;

a floor plate part that is enabled to slide with respect to the body in the second direction between a first position at which the floor plate part overlaps the horizontal stand in a top view and a second position that is on the second side relative to the first position;

a mattress part that is enabled to be placed on the floor plate part; and a cushion element that is enabled to be placed on the mattress part in a state in which the floor plate part is at the first position and the cushion element abuts onto the horizontal stand in the second direction, wherein an upper side surface of the mattress part extends at a height lower than a lower end of a side surface of the horizontal stand on the second side in the second direction in a placed state in which the mattress part is placed on the floor plate part, a space is formed under a horizontal surface of the horizontal stand in a state in which the floor plate part is at the second position, the space being capable of storing the cushion element, and the space being next to the mattress part in the placed state, and a part of the first side of the mattress part in the second direction in the placed state is in the space in a state where the floor plate part is at the first position, and wherein the cushion element is enabled to be stored in the space in a predetermined position, and an upper end of the cushion element in the space in the predetermined position is positioned higher than the upper surface of the mattress part in the placed state, and wherein the cushion element is enabled to be placed between the first side plates in a state in which the floor plate part is at the first position.

2. The furniture according to claim 1, wherein the mattress part and the cushion element have a same surface material.

3. The furniture according to claim 1, wherein the mattress part includes a built-in spring coil, and includes a part of urethane material above the spring coil.

4. The furniture according to claim 1, wherein the cushion element is enabled to be stored in the space in a predetermined position, and in a state in which the floor plate part is at the second position, a length of the cushion element in the second direction in the predetermined position in the space is substantially equal to a length between the second side plate and the mattress part in the placed state.

5. The furniture according to claim 4, wherein a state in which the floor plate part is at the second position is a state in which the mattress part in the placed state or the floor plate part is in contact with the cushion element in the predetermined position in the space in the second direction, and in the state in which the floor plate part is at the second position, the length of the cushion element in the second direction in the predetermined position in the space is substantially equal to a length of the horizontal stand in the second direction.

6. The furniture according to claim 1, wherein the body supports the floor plate part in such a way that the floor plate part is enabled to slide.

7. The furniture according to claim 6, wherein the body further includes one or more first support elements that extend in the second direction at a position between the first side plates in the first direction, and the first support element supports a lower surface of the floor plate part in such a way that the floor plate part is enabled to slide.

8. The furniture according to claim 7, wherein the body further includes second support elements that are attached to the first side plates, and a third support element that is provided at the ends of the first support element and the second support elements on the second side in the second direction, and that extends in the first direction, and the second support elements and the third support element support the lower surface of the floor plate part in such a way that the floor plate part is enabled to slide.

9. The furniture according to claim 8, wherein the floor plate part includes a fourth support element, on a lower surface of the floor plate part, that extends in parallel with the second side plate, the fourth support element is provided at a position shifted towards the first side with respect to an edge of the slide floor plate on the second side in the second direction, the floor plate part further includes a convex part on the lower surface on the second side relative to the fourth support element in the second direction.

10. The furniture according to claim 8, wherein the body supports the floor plate part in such a way that the floor plate part is enabled to slide between the first position and a third position that is on the second side of the second position in the second direction, the floor plate part includes a stopper, on the lower surface, that protrudes downwards, the stopper stops the sliding of the floor plate part towards the second side in the second direction by abutting onto the third support element in a state in which the floor plate part is at the third position.

11. The furniture according to claim 10, wherein the cushion element is enabled to be stored in the space in a predetermined position, and a gap, which is equal to or greater than a length of the cushion element in the second direction in the predetermined position, is formed between the side surface of the horizontal stand and the mattress par in the placed state, in a state in which the floor plate part is at the third position.

12. The furniture according to claim 10, wherein the first support element abuts onto the second side plate in the second direction and partitions a lower side of the space into sections with predetermined lengths in the first direction, the number of the cushion elements is greater than the number of the first support elements by one, and a length of each of the cushion elements in the first direction corresponds to the predetermined length.

13. A bed-sofa body comprising:

a body including first side plates on both sides in a first direction, a second side plate on a first side in a second direction that is perpendicular to the first direction and an up-and-down direction, and a horizontal stand that forms a horizontal surface extending from the second side plate to a second side that is an opposite side of the first side in the second direction; and a floor plate part, on which a mattress part is enabled to be placed, that is enabled to slide with respect to the body in the second direction between a first position at which the floor plate part overlaps the horizontal stand in a top view and a second position that is on the second side of the first position, wherein a space is formed under a horizontal surface of the horizontal stand in a state in which the floor plate part is at the second position, the space being next to the mattress part in the second direction which is placed on the floor plate part, wherein the body further includes one or more first support elements that extend in the second direction at a position between the first side plates in the first direction, and the first support element supports a lower surface of the floor plate part in such a way that the floor plate part is enabled to slide, and wherein the first support element abuts onto the second side plate in the second direction and partitions a lower side of the space into sections with predetermined lengths in the first direction.

* * * * *